US007066841B2

(12) United States Patent
Sasaki et al.

(10) Patent No.: US 7,066,841 B2
(45) Date of Patent: Jun. 27, 2006

(54) GOLF BALL

(75) Inventors: Takashi Sasaki, Kobe (JP); Takahiro Sajima, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 151 days.

(21) Appl. No.: 10/680,196

(22) Filed: Oct. 8, 2003

(65) Prior Publication Data

US 2005/0014577 A1 Jan. 20, 2005

(30) Foreign Application Priority Data

Oct. 30, 2002 (JP) ..... 2002-315986

(51) Int. Cl.
*A63B 37/12* (2006.01)

(52) U.S. Cl. ..... 473/383

(58) Field of Classification Search ..... 473/378–385, 473/373, 374, 368

See application file for complete search history.

(56) References Cited

U.S. PATENT DOCUMENTS 4,813,677 A 3/1989 Oka et al.
5,080,367 A 1/1992 Lynch et al.
5,292,132 A 3/1994 Oka
6,241,627 B1 * 6/2001 Kasashima et al. ..... 473/384
2003/0050138 A1 * 3/2003 Kasashima ..... 473/384
2003/0060307 A1 * 3/2003 Umezawa et al. ..... 473/371
2003/0190979 A1 * 10/2003 Sajima ..... 473/383

* cited by examiner

*Primary Examiner*—Raeann Gorden
(74) *Attorney, Agent, or Firm*—Birch, Stewart, Kolasch & Birch, LLP

(57) ABSTRACT

A golf ball containing a core and a cover, the core being composed of a center and a mid layer. Numerous dimples are formed on the surface of the cover. The cover includes a thermoplastic polyurethane elastomer as a principal component. The Shore D hardness of the cover is 30 or greater and 55 or less. The surface area occupation ratio Y of the dimples is equal to or greater than 75%. A ratio R1 of the diameter $d_{max}$ of the maximum dimple to the diameter D of the golf ball is 11.0% or greater and 18.0% or less. A ratio R2 of the number of dimples having the diameter d accounting for 11.0% or greater and 18.0% or less of the diameter D of the golf ball to the total number N of the dimples is equal to or greater than 20%.

4 Claims, 20 Drawing Sheets

GOLF BALL

This nonprovisional application claims priority under 35 U.S.C. §119(a) on Patent Application No(s). 2002-315986 filed in JAPAN on Oct. 30, 2002, which is(are) herein incorporated by reference.

BACKGROUND OF THE INVENTION

1. Field of the Invention

The present invention relates to golf balls. More particularly, the present invention relates to golf balls having a core and a cover, with dimples being formed on the cover.

2. Description of the Related Art

Generally speaking, golf balls other than those manufactured for use in practice ranges have a core and a cover. There exist cores composed of a single solid rubber layer, two or more solid rubber layers, a synthetic resin layer in addition to a solid rubber layer, and the like.

Numerous dimples are formed on the surface of the cover. The role of the dimples involves causing turbulent flow detachment through promoting turbulent flow transition of a boundary layer by disrupting the air flow around the golf ball during its flight. By promoting turbulent flow transition, the detachment point of the air from the golf ball shifts backwards leading to the reduction of a drag coefficient (Cd) so that the flight distance of the golf ball is prolonged. In addition, the difference of detachment points on the upper and lower sides of the golf ball resulting from back spin is increased by the promotion of turbulent flow transition. Therefore, the, lift force that acts on the golf ball is elevated.

Various golf balls that are provided with an improved dimple pattern to which the improvement of the flight performance is intended have been proposed. For example, JP-A-50744/1983 discloses a golf ball having dimples densely arranged so that pitches between the dimples are equal to or less than 1.62 mm as much as possible. Further, JP-A-192181/1987 discloses a golf ball having dimples densely arranged so that any new dimple can not be formed having an area greater than the average area, on the land parts that are parts other than the original dimples. Moreover, JP-A-347177/1992 discloses a golf ball having dimples, significantly densely arranged, so that the number of the land parts on which a rectangle having a predetermined size can be depicted is equal to or less than 40.

Any of the golf balls disclosed in these known literatures has dimples that are densely arranged. In other words, they have an increased surface area occupation ratio of the dimples. One skilled in the art acknowledges that a critical factor that influences the effects of dimples is the surface area occupation ratio.

Performances of a golf ball on which great importance is placed include spin performances. High back spin speed results in small run (a distance from the position where the golf ball dropped to a position where it stopped, also referred to as "roll"). In other words, for golf players, golf balls which can be spun backwards tend to stop at a targeted position. High side spin speed results in the possibility of curving the golf ball. In other words, for golf players, golf balls which can be side spun tend to intentionally curve. Thus, golf balls that are excellent in spin performances are excellent in control performances. Senior golf players particularly place great importance on control performances upon impact with a short iron.

In general, an ionomer resin is used for the golf ball cover. Ionomer reins are excellent in durability and resilience. However, ionomer resins, in general, have high hardness.

Golf balls having a cover composed of an ionomer resin are also inferior in control performances. A cover in which a hard ionomer resin and a ternary copolymer-based soft ionomer resin are used in combination has been proposed with the intention of improving the control performances. Furthermore, a cover in which an ionomer resin and a thermoplastic elastomer are used in combination has been also proposed. In addition, a cover composed of a thermosetting polyurethane elastomer or a thermoplastic polyurethane elastomer has been also proposed.

Travel distance and control performances, which are required performances for a golf ball, are conflicting performances. Accordingly, a golf ball that is satisfactory enough to golf players has not yet been obtained. Thus, an object of the present invention is to provide golf balls which are excellent in both flight performance and a controlled performance.

SUMMARY OF THE INVENTION

The golf ball according to the present invention has a core, a cover and numerous dimples formed on the surface of the cover. A base polymer of this cover includes a thermoplastic polyurethane elastomer as a principal component. The Shore D hardness of this cover is 30 or greater and 55 or less. The surface area occupation ratio Y of the dimples is equal to or greater than 75%. The ratio R1 of the diameter $d_{max}$ of the maximum dimple to the diameter D of the golf ball is 11.0% or greater and 18.0% or less.

Since the base polymer of the cover includes a thermoplastic polyurethane elastomer as a principal component, and the Shore D hardness of the cover is 30 or greater and 55 or less, the golf ball is excellent in its control performance. The golf ball is also excellent in flight performance. Although the details for the excellent flight performance of this golf ball are uncertain, it is speculated that the maximum dimple is responsible for a decrease of the drag coefficient (Cd), particularly a decrease of the drag coefficient (Cd) in a high speed area immediately after impact.

Preferably, a ratio R2 of number of dimples having a diameter d accounting for 11.0% or greater and 18.0% or less of the diameter D of the golf ball, occupied in total number N of the dimples is equal to or greater than 20%. This golf ball exhibits excellent flight performance.

Preferably, a mean occupation ratio y is equal to or greater than 0.22%. This golf ball has a number of dimples having a relatively large size. Large sized dimples are responsible for the improvement of the aerodynamic characteristics of the golf ball. The mean occupation ratio y is a value calculated by dividing the surface area occupation ratio Y by total number N of dimples.

Preferably, a summation X of the contour length x of the dimples (total contour length) and the surface area occupation ratio Y satisfy the relationship represented by the following formula (1).

$$X \leqq 38.82 \times Y + 1495 \quad (1)$$

This golf ball is provided with a dimple pattern in which the total contour length X is small contrary to the surface area occupation ratio Y. This golf ball exhibits excellent flight performance.

The present invention exerts a marked effect when the golf ball has a core composed of a center and a mid layer, and difference (Hm−Hc) between Shore D hardness Hm of the mid layer and Shore D hardness Hc of the cover is equal to or greater than 5.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

The present invention is hereinafter described in detail with appropriate references to the accompanying drawing according to the preferred embodiments of the present invention.

Figure 1:
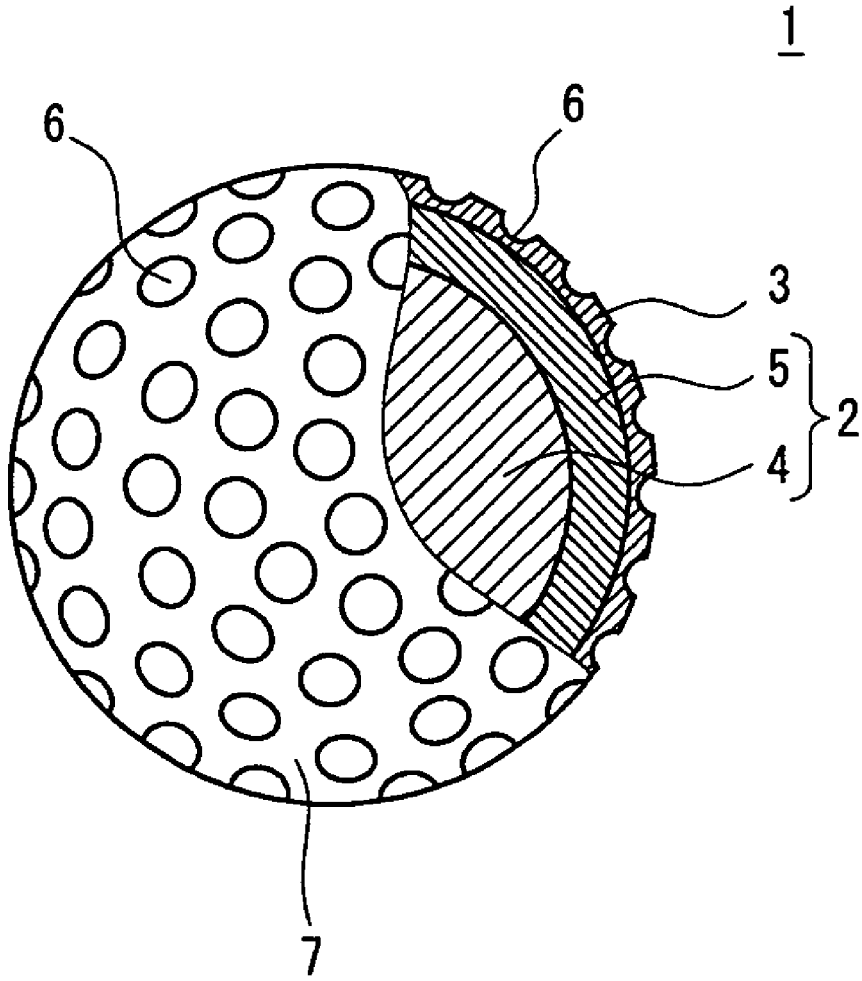
FIG. 1 is a schematic cross-sectional view illustrating a golf ball according to one embodiment of the present invention.

A golf ball 1 depicted in FIG. 1 has a spherical core 2 and a cover 3. The core 2 is composed of a spherical center 4 and a mid layer 5. Numerous dimples 6 are formed on the surface of the cover 3. Of the cover 3, a part except for the dimples 6 is a land 7. Although this golf ball 1 has a paint layer and a mark layer to the external side of the cover 3, these layers are not shown in the Figure. This golf ball 1 has the diameter of from 40 mm to 45 mm in general, and in particular, of from 42 mm to 44 mm. In light of the reduction of air resistance in the range to comply with a rule defined by United States Golf Association (USGA), the diameter is particularly preferably 42.67 mm or greater and 42.80 mm or less. The weight of this golf ball 1 is generally 40 g or greater and 50 g or less, and in particular, 44 g or greater and 47 g or less. In light of the elevation of inertia in the range to comply with a rule defined by USGA, the weight is particularly preferably 45.00 g or greater and 45.93 g or less.

The cover 3 herein includes an outermost layer except for the paint layer and the mark layer. There exist golf balls referred to as having a two-layered cover, and in this instance, the outer layer corresponds to the cover 3 herein.

Base polymer of the cover 3 is a thermoplastic polyurethane elastomer. General thermoplastic polyurethane elastomers include a polyurethane component as a hard segment, and a polyester component or a polyether component as a soft segment. The thermoplastic polyurethane elastomer is responsible for the control performance of the golf ball 1. Further, the thermoplastic polyurethane elastomer is also responsible for the scuff resistance of the cover 3.

Illustrative examples of the curing agent for the polyurethane component include alicyclic diisocyanates, aromatic diisocyanates and aliphatic diisocyanates. Particularly, alicyclic diisocyanates are preferred. Because an alicyclic diisocyanate has no double bond in its main chain, yellowing of the cover 3 may be suppressed. In addition, because an alicyclic diisocyanate is excellent in the strength, scuffs of the cover 3 may be suppressed. Two or more kinds of diisocyanates may be used in combination.

Illustrative examples of the alicyclic diisocyanate include 4,4'-dicyclohexylmethane diisocyanate ($H_{12}MDI$) which is a hydrogenated product of 4,4'-diphenylmethane diisocyanate, 1,3-bis(isocyanatomethyl)cyclohexane ($H_6XDI$) which is a hydrogenated product of xylylene diisocyanate, isophorone diisocyanate (IPDI) and trans-1,4-cyclohexane diisocyanate (CHDI). In light of general-purpose properties and processing characteristics, $H_{12}MDI$ is preferred. Specific examples of the thermoplastic polyurethane elastomer including $H_{12}MDI$ as a constituent component include trade name "Elastolan XNY90A", trade name "Elastolan XNY97A" and trade name "Elastolan XNY585" of BASF Polyurethane Elastomers Ltd.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

As a base polymer of the cover 3, other synthetic resin may be used together with the thermoplastic polyurethane elastomer. When other synthetic resin is used with the thermoplastic polyurethane elastomer in combination, the thermoplastic polyurethane elastomer is included as a principal component, in light of the control performance. Proportion of the thermoplastic polyurethane elastomer occupied in total base polymer is preferably equal to or greater than 50% by weight, more preferably equal to or greater than 60% by weight, and particularly preferably equal to or greater than 70% by weight.

Illustrative examples of the synthetic resin which may be used include thermoplastic polyamide elastomers, thermoplastic polyester elastomers, thermoplastic polyolefin elastomers and ionomer resins. A synthetic resin having a polar group such as a carboxyl group, a glycidyl group, a sulfone group, an epoxy group or the like may also be used. In particular, thermoplastic polyamide elastomers are preferred. A thermoplastic polyamide elastomer is excellent in compatibility with a thermoplastic polyurethane elastomer. The thermoplastic polyamide elastomer is also responsible for the resilience performance of the golf ball 1. When a thermoplastic polyurethane elastomer and a thermoplastic polyamide elastomer are used in combination, weight ratio of both components is preferably 70/30 or greater and 95/5 or less.

General thermoplastic polyamide elastomers include a polyamide component as a hard segment, and a polyester component or a polyether component as a soft segment. A suitable soft segment is a polyether component. Specific examples of suitable thermoplastic polyamide elastomers include trade name "Pevax 5533" and "Pevax 4033" of ATOFINA Japan Co., Ltd.

To the cover 3 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 3 may be blended with powder of a highly dense metal such as tungsten, molybdenum or the like for the purpose of adjusting the specific gravity.

The Shore D hardness Hc of the cover 3 is 30 or greater and 55 or less. In other words, the cover 3 has a soft nature. By employing a soft cover 3, the contact time period and the contact area of the golf ball 1 with the club face upon impact with the golf club are increased. The spin performance of the golf ball 1 is thereby improved, leading to the improvement in the control performance. In this respect, hardness Hc of the cover 3 is more preferably equal to or less than 50. When the hardness Hc of the cover 3 is too low, the resilience performance of the golf ball 1 becomes insufficient. Therefore, the hardness Hc is more preferably equal to or greater than 35, and particularly preferably equal to or greater than 40.

The thickness of the cover 3 is preferably 0.2 mm or greater and 2.0 mm or less. When the thickness is less than the above range, the control performance and durability of the golf ball 1 may become insufficient. In this respect, the thickness is more preferably equal to or greater than 0.3 mm, and particularly preferably equal to or greater than 0.5 mm. When the thickness is beyond the above range, the resilience performance and the flight performance of the golf ball 1 may become insufficient. In this respect, the thickness is more preferably equal to or less than 1.8 mm, and particularly preferably equal to or less than 1.5 mm.

Figure 2:
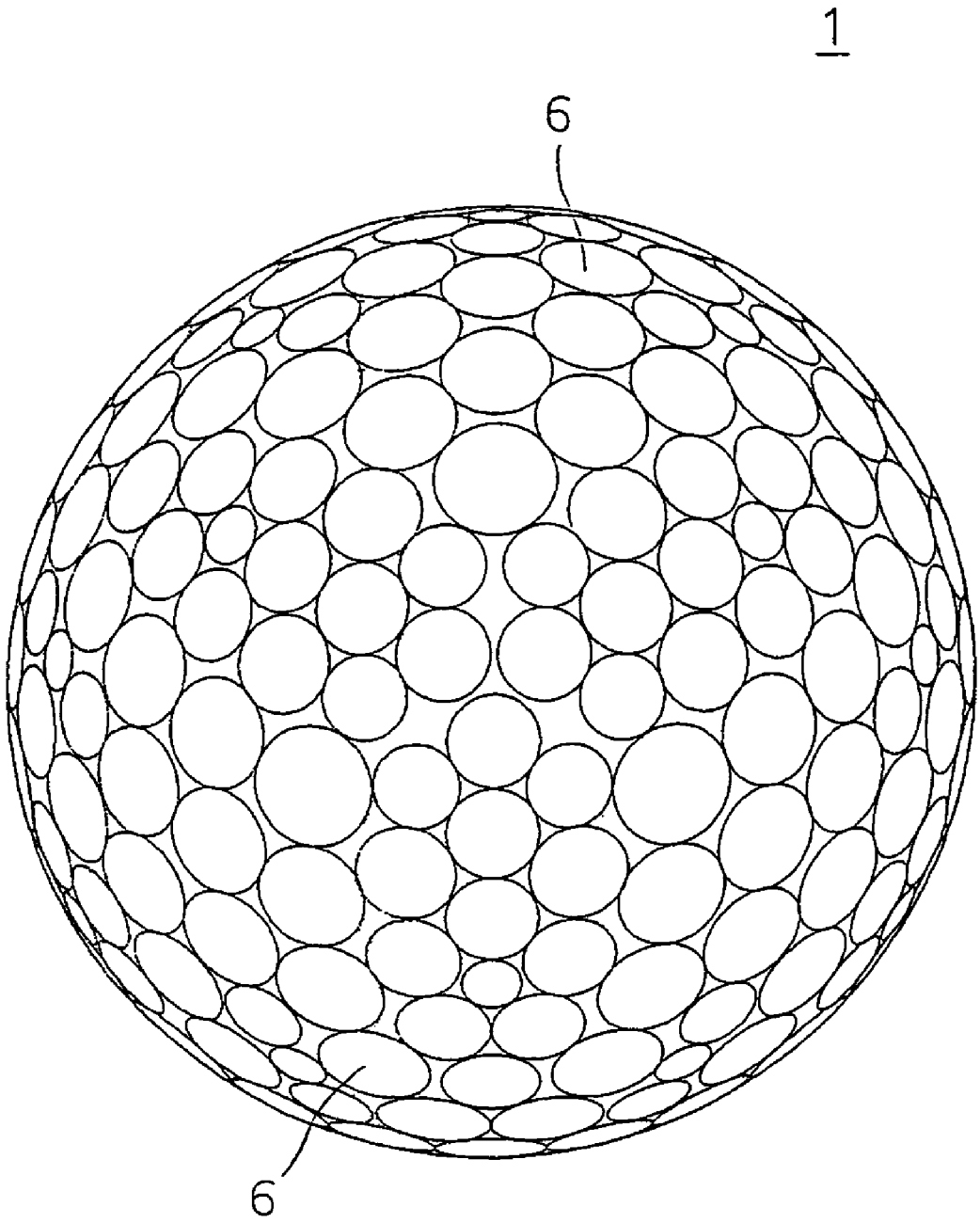
FIG. 2 is an enlarged plan view illustrating the golf ball shown in FIG. 1.
Figure 3:
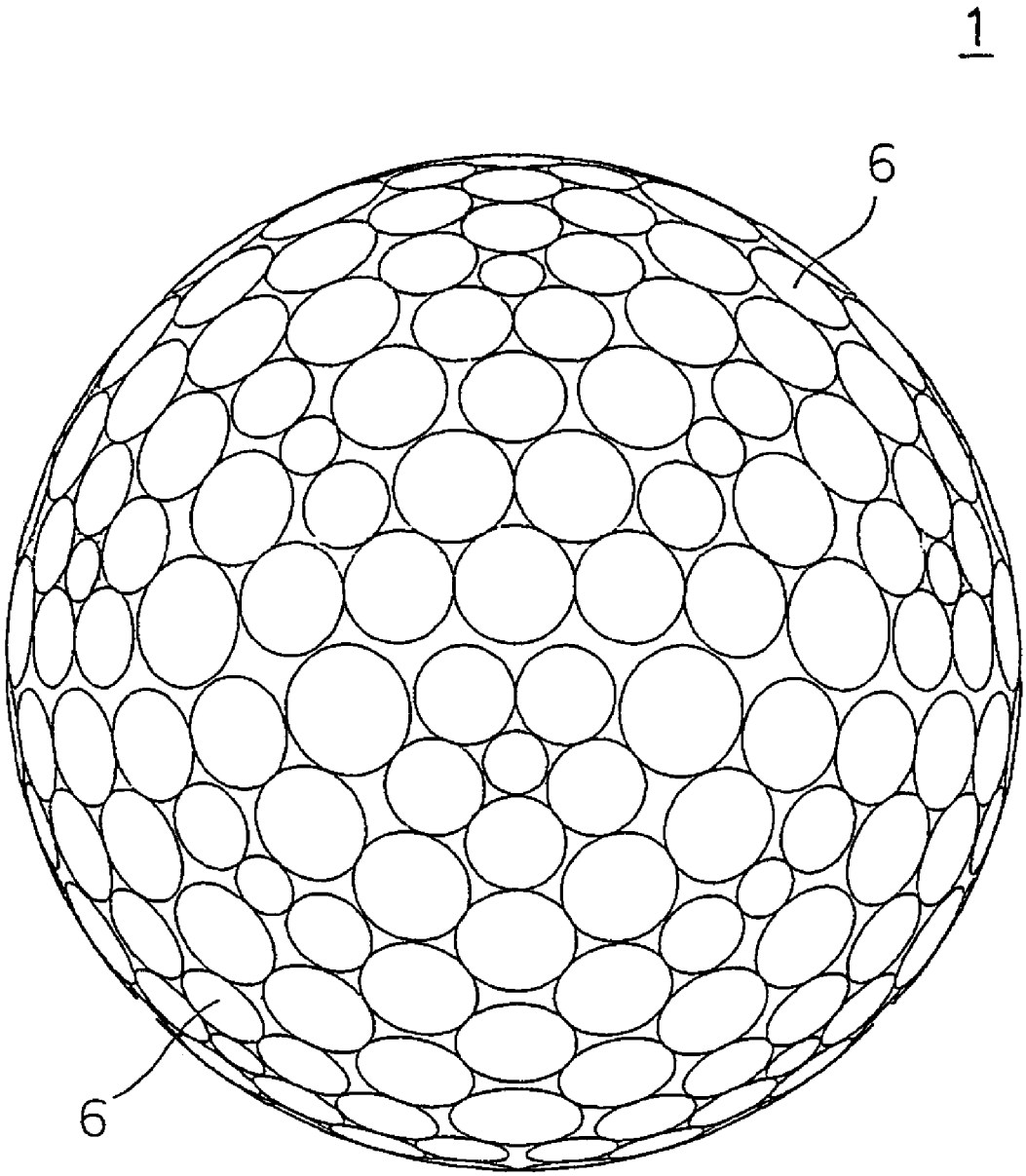
FIG. 3 is a front view illustrating the golf ball shown in FIG. 2.

FIG. 2 is an enlarged plan view illustrating the golf ball 1 shown in FIG. 1, and FIG. 3 is a front view of the same. This golf ball 1 includes A dimples having a plane circular shape with a diameter of 5.60 mm, B dimples having a plane circular shape with a diameter of 5.10 mm, C dimples having a plane circular shape with a diameter of 4.85 mm, D dimples having a plane circular shape with a diameter of 4.50 mm, E dimples having a plane circular shape with a diameter of 4.25 mm, F dimples having a plane circular shape with a diameter of 3.90 mm, and G dimples having a plane circular shape with a diameter of 2.75 mm. The number of the A dimple is 18; the number of the B dimple is 102; the number of the C dimple is 24; the number of the D dimple is 18; the number of the E dimple is 72; the number of the F dimple is 36; and the number of the G dimple is 24. The total number N of the dimples of this golf ball 1 is 294.

The maximum dimple herein means any dimple having the largest diameter. In instances of a non-circular dimple, a circular dimple having the same area with the non-circular dimple is envisioned, and the diameter of this circular dimple is assumed as the diameter of the non-circular dimple. The maximum dimple of the golf ball 1 depicted in FIG. 2 and FIG. 3 is the A dimple. In other words, the diameter $d_{max}$ of the maximum dimple is 5.60 mm. The ratio R1 of the diameter $d_{max}$ of the maximum dimple (in this instance, 5.60 mm) to the diameter D of the golf ball 1 (in this instance, 42.70 mm) is 13.1%.

In this golf ball 1, the ratio R1 is greater in comparison with those of conventional golf balls. In other words, the maximum dimple is significantly large. This maximum dimple is responsible for the aerodynamic characteristics, which impart an excellent flight performance to the golf ball 1. According to this golf ball 1, the flight performance and the control performance are both accomplished concurrently. In light of the aerodynamic characteristics, the ratio R1 is set to be equal to or greater than 11.0%. The ratio R1 is more preferably equal to or greater than 12.0%, and particularly preferably equal to or greater than 13.0%. When the ratio R1 is too large, fundamental feature of the golf ball 1 which is a substantially spherical body may be compromised, leading to a deteriorated flight performance, or may result in difficulty in the rolling of the golf ball 1 on the green. In this respect, the ratio R1 is set to be equal to or less than 18.0%. The ratio R1 is more preferably equal to or less than 17.0%, and particularly preferably equal to or less than 16.0%.

The dimple 6 having the diameter d accounting for 11.0% or greater and 18.0% or less of the diameter D of the golf ball 1 is responsible for the aerodynamic characteristics of the golf ball 1. The ratio R2 of number of dimples 6 having the diameter d accounting for 11.0% or greater and 18.0% or less of the diameter D of the golf ball 1, occupied in total number N of the dimples is preferably equal to or greater than 20%. The golf ball 1 having the ratio R2 of equal to or greater than 20% is excellent in the flight performance. In this respect, the ratio R2 is more preferably equal to or greater than 22%, and particularly preferably equal to or greater than 30%. The ratio R2 is ideally 100%.

In light of the flight performance, it is preferred that all of the dimples 6 have the diameter d accounting for equal to or greater than 5.0%, yet equal to or greater than 5.5%, and particularly equal to or greater than 5.8% of the diameter D of the golf ball 1.

Figure 4:
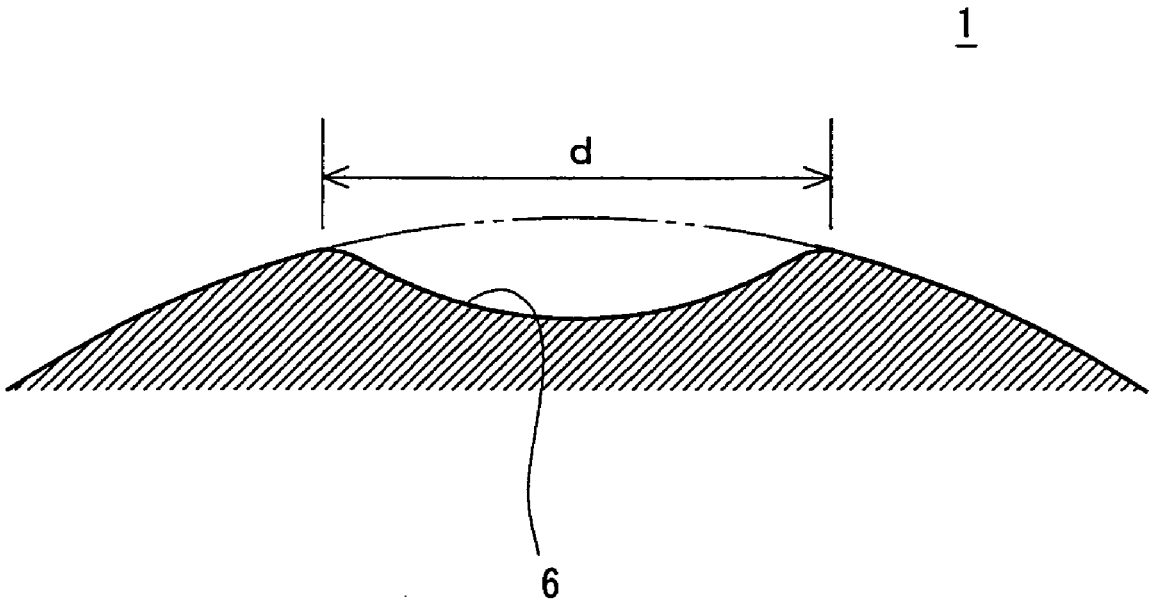
FIG. 4 is a schematic enlarged cross-sectional view illustrating a part of the golf ball shown in FIG. 1.

FIG. 4 is a schematic enlarged cross-sectional view illustrating a part of the golf ball 1 shown in FIG. 1. In this Figure, a cross-section traversing the deepest part of the dimple 6 is depicted. What is depicted by a double-sided arrowhead d in this Figure is a diameter of the dimple 6. This diameter d is a distance between both contact points when common tangent lines are depicted at both edges of the dimple 6. Further, the volume of space surrounded by a phantom sphere (a sphere when it was postulated that there is no dimple 6 existed, and is depicted by a chain double-dashed line in FIG. 4) of the golf ball 1 and the surface of the dimple 6 is the dimple volume.

The area of the dimple 6 is an area of a region surrounded by the contour of the dimple 6 when the center of the golf ball 1 is viewed at infinity (i.e., an area of the plane shape). In the instance of a circular dimple 6, the area s is calculated by the following formula.

$$s=(d/2)^2\times\pi$$

In the golf ball 1 shown in FIG. 2 and FIG. 3, the area s of the A dimple is 24.63 $mm^2$; the area s of the B dimple is 20.43 $mm^2$; the area s of the C dimple is 18.47 $mm^2$; the area s of the D dimple is 15.90 $mm^2$; the area s of the E dimple is 14.19 $mm^2$; the area s of the F dimple is 11.95 $mm^2$; and the area s of the G dimple is 5.94 $mm^2$. Accordingly, a summation of the dimple areas (total area) S is 4850.7 $mm^2$. The ratio of this total area S to the surface area of the phantom sphere is the surface area occupation ratio Y. According to this golf ball 1, the surface area occupation ratio Y is 84.68%. The mean occupation ratio y is calculated by dividing this surface area occupation ratio Y by total number of the dimples. According to golf ball 1, the mean occupation ratio y is 0.288%. The mean occupation ratio y means the area ratio of the dimples 6 that have the mean area, occupied in the spherical surface of the phantom sphere.

It is preferred that the surface area occupation ratio Y is equal to or greater than 75%. When the surface area occupation ratio Y is less than the above range, lift force of the golf ball 1 during the flight may be deficient. In this respect, the surface area occupation ratio Y is more preferably equal to or greater than 78%, and particularly preferably equal to or greater than 80%. Common golf ball 1 has the surface area occupation ratio Y of equal to or less than 88%.

In an attempt to design a dimple pattern having a large surface area occupation ratio Y by a designer, there exists a means to achieve such a surface area occupation ratio Y by increasing the total number N of the dimples. Alternatively, there also exists a means to achieve such a surface area occupation ratio Y by increasing the diameter d of the dimples 6. When the designer predominantly employs the means in which such a surface area occupation ratio Y is achieved by increasing the diameter d of the dimples 6, the golf ball 1 having the mean occupation ratio y of equal to or greater than 0.22% can be obtained.

When the mean occupation ratio y is less than 0.22%, the drag coefficient (Cd) within a high speed area in the trajectory track may become so large that the flight distance of the golf ball 1 may be insufficient. In this respect, the mean occupation ratio y is more preferably equal to or greater than 0.24%, even more preferably equal to or greater than 0.26%, and particularly preferably equal to or greater than 0.28%. The golf ball 1 having a mean occupation ratio y that is excessively large, the fundamental feature of the golf ball 1 which is a substantially spherical body may not be sustained. Therefore, the mean occupation ratio y of common golf ball 1 is equal to or less than 0.40%.

Total number N of the dimples 6 is preferably equal to or less than 320. When the total number N is beyond the above range, individual dimples 6 become so small that a flight performance of the golf ball 1 may become insufficient. In this respect, total number N is more preferably equal to or less than 310, and particularly preferably equal to or less than 295. From the view point that the golf ball 1 can be in a substantially spherical shape while keeping the surface area occupation ratio Y of equal to or greater than 75%, it is preferred that total number N is equal to or greater than 210, and particularly equal to or greater than 230.

In the golf ball 1 shown in FIG. 2, the contour length x of the A dimple is 17.59 mm; the contour length x of the B dimple is 16.02 mm; the contour length x of the C dimple is 15.24 mm; the contour length x of the D dimple is 14.14 mm; the contour length x of the E dimple is 13.35 mm; the contour length x of the F dimple is 12.25 mm; and the contour length x of the G dimple is 8.64 mm. According to this golf ball 1, total contour length X that is a summation of the dimple contour length x is 4180.8 mm.

The contour length x of the dimple 6 refers to the length which is obtained by the actual measurement along the contour of the dimple 6. For example, in the instance of a dimple 6 having a triangular plane shape, the summation of length of the three edges corresponds to the contour length x. Because this edge is present on a spherical face, it has an arcuate shape in the strict sense. The length of this arc is assumed as the length of the edge. Furthermore, in the instance of a circular dimple 6, the contour length x is calculated by the following formula.

$$x=d\times\pi$$

It is preferred that the surface area occupation ratio Y and total contour length X satisfy the relationship represented by the following formula (1).

$$X\leqq 38.82\times Y+1495 \quad (1)$$

According to this golf ball 1, total contour length X is relatively small contrary to the surface area occupation ratio Y. This golf ball 1 exhibits small drag coefficient (Cd) during the flight, and thus this golf ball 1 is excellent in the flight performance. As long as the present inventor is aware, the golf ball 1 which satisfies the above formula (1) has not been present so far.

In light of the reduction of the drag coefficient (Cd) it is more preferred that total contour length X and the surface area occupation ratio Y satisfy the following formula (2); it is even more preferred that both satisfy the following formula (3); and it is particularly preferred that both satisfy the following formula (4).

$$X\leqq 38.82\times Y+1445 \quad (2)$$

$$X\leqq 38.82\times Y+1335 \quad (3)$$

$$X\leqq 38.82\times Y+1085 \quad (4)$$

In order to sustain the fundamental feature of the golf ball 1 which is a substantially spherical body, total contour length X and the surface area occupation ratio Y are required to satisfy the relationship represented by the following formula (5).

$$X\leqq 38.82\times Y+95 \quad (5)$$

Although total contour length X is determined ad libitum on the basis of the relationship with the surface area occupation ratio Y in the range to satisfy the above formula (1), it is usually 2800 mm or greater and 5000 mm or less, and particularly, 3100 mm or greater and 4700 mm or less.

In light of the reduction of the drag coefficient (Cd), number of the dimples 6 having the contour length x of equal to or greater than 10.5 mm accounts for preferably equal to or greater than 91%, and particularly preferably equal to or greater than 95% of total number of the dimples. This percentage is ideally 100%.

Depth of the dimple 6 (a distance between the phantom spherical face and the deepest part of the dimple 6) is preferably 0.05 mm or greater and 1.00 mm or less. When the depth is less than the above range, transition of a turbulent flow hardly occurs. In this respect, the depth is more preferably equal to or greater than 0.10 mm, and particularly preferably equal to or greater than 0.15 mm. When the depth is beyond the above range, the dimples 6 are likely to be filled with earth. In this respect, the depth is more preferably equal to or less than 0.85 mm, and particularly preferably equal to or less than 0.70 mm.

Although the dimples 6 formed may be of only one type, it is preferred that two or more types, particularly three or more types of the dimples 6 having different diameter or depth are formed, in light of a flight performance. In stead of the circular dimples 6, or together with the circular dimples 6, non-circular dimples (dimples of which plane shape is not circular) may be also formed. Specific examples of the non-circular dimple include polygonal dimples, elliptical dimples, oval dimples, egg-shaped dimples and the like.

Summation of the dimple volume (total volume) is preferably 400 $mm^3$ or greater and 800 $mm^3$ or less. When the total volume is less than the above range, hopping trajectory may be provided. In this respect, the total volume is more preferably equal to or greater than 450 $mm^3$, and particularly preferably equal to or greater than 500 $mm^3$. When the total volume is beyond the above range, dropping trajectory may be provided. In this respect, the total volume is more preferably equal to or less than 770 $mm^3$, and particularly preferably equal to or less than 750 $mm^3$.

It is preferred that the golf ball 1 has no great circle path at all. The great circle path means a great circle which does not cross with any of the dimples 6. Upon the molding of the golf ball 1, a mold comprising upper and lower portions, both of which having a hemisphere cavity is employed. By using a mold having a parting line with uneven shape having concavity and convexity between the upper mold and the lower mold, a golf ball 1 having no great circle path at all can be molded.

In general, the center 4 is obtained through crosslinking of a rubber composition. Examples of suitable base rubber for use in the rubber composition include polybutadienes, polyisoprenes, styrene-butadiene copolymers, ethylene-propylene-diene copolymers, natural rubbers and the like. Two or more kinds of these rubbers may be used in combination. In light of the resilience performance, polybutadienes are preferred. In the case where another rubber is used in combination with a polybutadiene, to employ a polybutadiene as a predominant component is preferred. More specifically, it is preferred that a proportion of polybutadiene occupied in total base rubber be equal to or greater than 50% by weight, and particularly equal to or greater than 80% by weight. Polybutadienes which have a percentage of the cis-1, 4 bond of equal to or greater than 40%, and particularly equal to or greater than 80% are preferred.

For crosslinking of the center 4, a co-crosslinking agent is usually used. Preferable co-crosslinking agent in light of the resilience performance is a monovalent or bivalent metal salt of α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, also an α,β-unsaturated carboxylic acid having 2 to 8 carbon atoms, and a metal oxide may be blended. Both components react in the rubber composition to give a salt. This salt serves as a co-crosslinking agent. Examples of preferable α,β-unsaturated carboxylic acid include acrylic acid and methacrylic acid. Examples of preferable metal oxide include zinc oxide and magnesium oxide.

The amount of the co-crosslinking agent to be blended is preferably 10 parts by weight or greater and 50 parts by weight or less per 100 parts by weight of the base rubber. When the amount to be blended is less than the above range, the resilience performance of the golf ball 1 may become insufficient. In this respect, the amount to be blended is more preferably equal to or greater than 15 parts by weight. When the amount to be blended is beyond the above range, the feel at impact of the golf ball 1 may become hard. In this respect, the amount to be blended is more preferably equal to or less than 45 parts by weight.

In the rubber composition for use in the center 4, an organic peroxide may be preferably blended together with the co-crosslinking agent. The organic peroxide is responsible for a crosslinking reaction. By blending the organic peroxide, the resilience performance of the golf ball 1 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount to be blended is less than the above range, the resilience performance of the golf ball 1 may become insufficient. In this respect, the amount to be blended is more preferably equal to or greater than 0.3 part by weight, and particularly preferably equal to or greater than 0.5 part by weight. When the amount to be blended is beyond the above range, the feel at impact of the golf ball 1 may become hard. In this respect, the amount to be blended is particularly preferably equal to or less than 2.5 parts by weight.

The center 4 may be blended with a filler for the purpose of adjusting specific gravity and the like. Illustrative examples of suitable filler include zinc oxide, barium sulfate, calcium carbonate and magnesium carbonate. Powder of highly dense metal may be blended as a filler. Specific examples of the highly dense metal include tungsten and molybdenum. The amount of the filler to be blended is determined ad libitum so that the intended specific gravity of the center 4 can be accomplished. Particularly preferable filler is zinc oxide. Zinc oxide serves not only as a mere agent for adjusting specific gravity but also as a crosslinking activator??. Various kinds of additives such as sulfur, an anti-aging agent, a coloring agent, a plasticizer, a dispersant and the like may be blended at an appropriate amount to the center 4 as needed. The center 4 may be further blended with crosslinked rubber powder or synthetic resin powder.

The diameter of the center 4 in general is set to be 25 mm or greater and 41 mm or less, and particularly 27 mm or greater and 40 mm or less. Crosslinking temperature of the center 4 is usually from 140° C. or greater and 180° C. or less. The crosslinking time period of the center 4 is usually 10 minutes or longer and 60 minutes or less.

The mid layer S may be composed of a crosslinked rubber, or may be composed of a resin composition. When it is composed of a crosslinked rubber, the base rubber thereof may be similar to the base rubber for the center 4 as described above. Furthermore, a similar co-crosslinking agent and organic peroxide to those which may be blended in the center 4 as described above can be blended. The amount of the co-crosslinking agent to be blended is preferably 15 parts by weight or greater and 50 parts by weight or less per 100 parts by weight of the base rubber. When the amount to be blended is less than the above range, the resilience performance of the golf ball 1 may become insufficient. In this respect, the amount to be blended is more preferably equal to or greater than 20 parts by weight. When the amount to be blended is beyond the above range, the feel at impact of the golf ball 1 may become deteriorated. In this respect, the amount to be blended is more preferably equal to or less than 45 parts by weight, and particularly preferably equal to or less than 40 parts by weight.

The amount of the organic peroxide to be blended in the mid layer 5 is preferably 0.1 part by weight or greater and 6.0 parts by weight or less per 100 parts by weight of the base rubber. When the amount to be blended is less than the above range, the resilience performance of the golf ball 1 may become insufficient. In this respect, the amount to be blended is more preferably equal to or greater than 0.3 part by weight, and particularly preferably equal to or greater than 0.5 part by weight. When the amount to be blended is beyond the above range, the feel at impact of the golf ball 1 may become hard. In this respect, the amount to be blended is more preferably equal to or less than 5.0 parts by weight, and particularly preferably equal to or less than 4.0 parts by weight. Also in the mid layer 5, may be blended a similar filler and various kinds of additives to those which may be blended in the center 4 as described above.

When the mid layer 5 is composed of a resin composition, examples of suitable base polymer include ionomer resins, thermoplastic polyester elastomers, thermoplastic polyamide elastomers, thermoplastic polyurethane elastomers, thermoplastic polyolefin elastomers and thermoplastic polystyrene elastomers. Two or more kinds of synthetic resins may be used in combination.

Of the ionomer resins, copolymers of α-olefin and an α, β-unsaturated carboxylic acid having 3 to 8 carbon atoms in which part of the carboxylic acid is neutralized with a metal ion are suitable. Preferable α-olefin is ethylene and propylene. Preferable α, β-unsaturated carboxylic acid is acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 1, particularly suitable metal ions are sodium ion, zinc ion, lithium ion and magnesium ion.

In the mid layer 5 may be blended a filler for the purpose of adjusting specific gravity and the like. Illustrative examples of suitable filler include zinc oxide, barium sulfate, calcium carbonate and magnesium carbonate. Powder of highly dense metal may be blended as a filler. Specific examples of the highly dense metal include tungsten and molybdenum. The amount of the filler to be blended is determined ad libitum so that the intended specific gravity of the mid layer 5 can be accomplished. The mid layer 5 may be also blended with a coloring agent, crosslinked rubber powder or synthetic resin powder.

Thickness of the mid layer 5 is preferably 0.5 mm or greater and 4.0 mm or less. When the thickness is less than the above range, the resilience performance of the golf ball 1 may become insufficient. In this respect, the thickness is more preferably equal to or greater than 0.7 mm. When the thickness is beyond the above range, the feel at impact of the golf ball 1 may become insufficient. In this respect, the thickness is more preferably equal to or less than 3.0 mm, and particularly preferably equal to or less than 2.0 mm.

Shore D hardness Hm of the mid layer 5 is preferably equal to or greater than 55. The resilience performance of the golf ball 1 is thereby improved. In this respect, the hardness Hm is more preferably equal to or greater than 58, and particularly preferably equal to or greater than 60. When the hardness Hm is extremely high, the feel at impact of the golf ball 1 becomes insufficient. In this respect, the hardness Hm is preferably equal to or less than 70, and more preferably equal to or less than 65.

Difference (Hm−Hc) between Shore D hardness Hm of the mid layer 5 and Shore D hardness Hc of the cover 3 is preferably equal to or greater than 5. The resilience performance of the golf ball 1 is thereby improved. In this respect, the difference of hardness (Hm−Hc) is more preferably equal to or greater than 8, and particularly preferably equal to or greater than 10. When the difference of hardness (Hm−Hc) is extremely large, the feel at impact of the golf ball 1 becomes insufficient. In this respect, the difference of hardness (Hm−Hc) is preferably equal to or less than 40, more preferably equal to or less than 35, and particularly preferably equal to or less than 30. Shore D hardness of the cover 3 and the mid layer 5 is measured in accordance with a standard of "ASTM-D2240-68", with a Shore D type spring hardness scale. When the subject to be measured (cover 3 or mid layer 5) consists of a resin composition, the hardness is measured with a slab formed from this resin composition. When the subject to be measured consists of a crosslinked rubber composition, the hardness is measured with a slab prepared by crosslinking of this rubber composition under the identical condition to the crosslinking condition of the subject to be measured.

The center 4 of the golf ball 1 depicted in FIG. 1 is composed of a single layer, however, a center composed of two or more layers may be employed. Another mid layer may be provided between the center 4 and the mid layer 5, or another mid layer may be provided between the mid layer 5 and the cover 3. A core composed of a single layer without including any mid layer 5 may be also employed. In a golf ball 1 having two or more mid layers, it is preferred that in at least one mid layer, Shore D hardness Hm thereof is set to be greater than Shore D hardness Hc of the cover 3 by 5 or more; and Shore D hardness of that mid layer 5 is preferably equal to or greater than 55.

EXAMPLES

Specifications of a core, a cover and dimples were defined as presented in Table 1 below, and golf balls of Examples 1 to 8 and Comparative Examples 1 to 5 were obtained. The diameter of these golf balls is 42.7 mm. Details of the composition of the center, the mid layer and the cover are presented in Table 2; and details of specifications of the dimples are presented in Table 3 and Table 4.

TABLE 1

| | | | Specification of golf ball | | | | | | | | | | | | |
|---|---|---|---|---|---|---|---|---|---|---|---|---|---|---|---|
| | | | Example 1 | Example 2 | Example 3 | Example 4 | Example 5 | Example 6 | Example 7 | Example 8 | Com. Example 1 | Com. Example 2 | Com. Example 3 | Com. Example 4 | Com. Example 5 |
| Core | Center | Composition type | a | a | a | a | a | a | a | a | a | a | a | a | a |
| | | Diameter (mm) | 37.5 | 37.5 | 36.1 | 37.5 | 37.5 | 37.5 | 37.5 | 37.5 | 37.5 | 37.5 | 37.5 | 37.5 | 37.5 |
| | Mid layer | Composition type | c | c | b | c | c | c | c | c | c | c | c | c | c |
| | | Thickness (mm) | 1.3 | 1.3 | 2.0 | 1.3 | 1.3 | 1.3 | 1.3 | 1.3 | 1.3 | 1.3 | 1.3 | 1.3 | 1.3 |

TABLE 1-continued

Specification of golf ball

| | | Example 1 | Example 2 | Example 3 | Example 4 | Example 5 | Example 6 | Example 7 | Example 8 | Com. Example 1 | Com. Example 2 | Com. Example 3 | Com. Example 4 | Com. Example 5 |
|---|---|---|---|---|---|---|---|---|---|---|---|---|---|---|
| Cover | Composition type | d | e | e | d | d | d | d | d | f | g | d | d | d |
| | Thickness (mm) | 1.3 | 1.3 | 1.3 | 1.3 | 1.3 | 1.3 | 1.3 | 1.3 | 1.3 | 1.3 | 1.3 | 1.3 | 1.3 |
| Dimple type | | I | I | I | II | III | IV | V | VI | I | I | VII | VIII | IX |

TABLE 2

Specification of center, mid layer and cover (parts by weight)

| Compostition Type | a | b | c | d | e | f | g |
|---|---|---|---|---|---|---|---|
| BR11 *1 | 100 | 100 | — | — | — | — | — |
| Zinc acrylate | 27 | 36 | — | — | — | — | — |
| Zinc oxide | 5 | 5 | — | — | — | — | — |
| Barium sulfate *2 | appropriate amount | appropriate amount | — | — | — | — | — |
| DCP *3 | 0.8 | 0.8 | — | — | — | — | — |
| Himilan 1605 *4 | — | — | 50 | — | — | 50 | 50 |
| Himilan 1706 *5 | — | — | 50 | — | — | — | — |
| Himilan 1557 *6 | — | — | — | — | — | 50 | — |
| Himilan AM7316 *7 | — | — | — | — | — | — | 50 |
| Elastolan XNY90A *8 | — | — | — | 80 | | — | — |
| Elastolan XNY97A *9 | — | — | — | | 80 | — | — |
| Pevax 5533 *10 | — | — | — | 20 | 20 | — | — |
| Titanium dioxide | — | — | — | 4 | 4 | 4 | 4 |

TABLE 2-continued

Specification of center, mid layer and cover (parts by weight)

| Compostition Type | a | b | c | d | e | f | g |
|---|---|---|---|---|---|---|---|
| Crosslinking temperature (° C.) | 160 | 170 | — | — | — | — | — |
| Crosslinking time (min) | 25 | 15 | — | — | — | — | — |

*1 polybutadiene of JSR Corporation
*2 adjusted to give the weight of the golf ball of 45.4 g
*3 Dicumyl peroxide
*4 Ionomer resin of Mitsui-Dupont Polychemical Co., Ltd.
*5 Ionomer resin of Mitsui-Dupont Polychemical Co., Ltd.
*6 Ionomer resin of Mitsui-Dupont Polychemical Co., Ltd.
*7 Ionomer resin of Mitsui-Dupont Polychemical Co., Ltd.
*8 Thermoplastic polyurethane elastomer of BASF Polyurethane Elastomers Ltd.
*9 Thermoplastic polyurethane elastomer of BASF Polyurethane Elastomers Ltd.
*10 Thermoplastic polyamide elastomer of ATOFINA Japan Co., Ltd.

TABLE 3

Specification of Dimples

Figure 5:
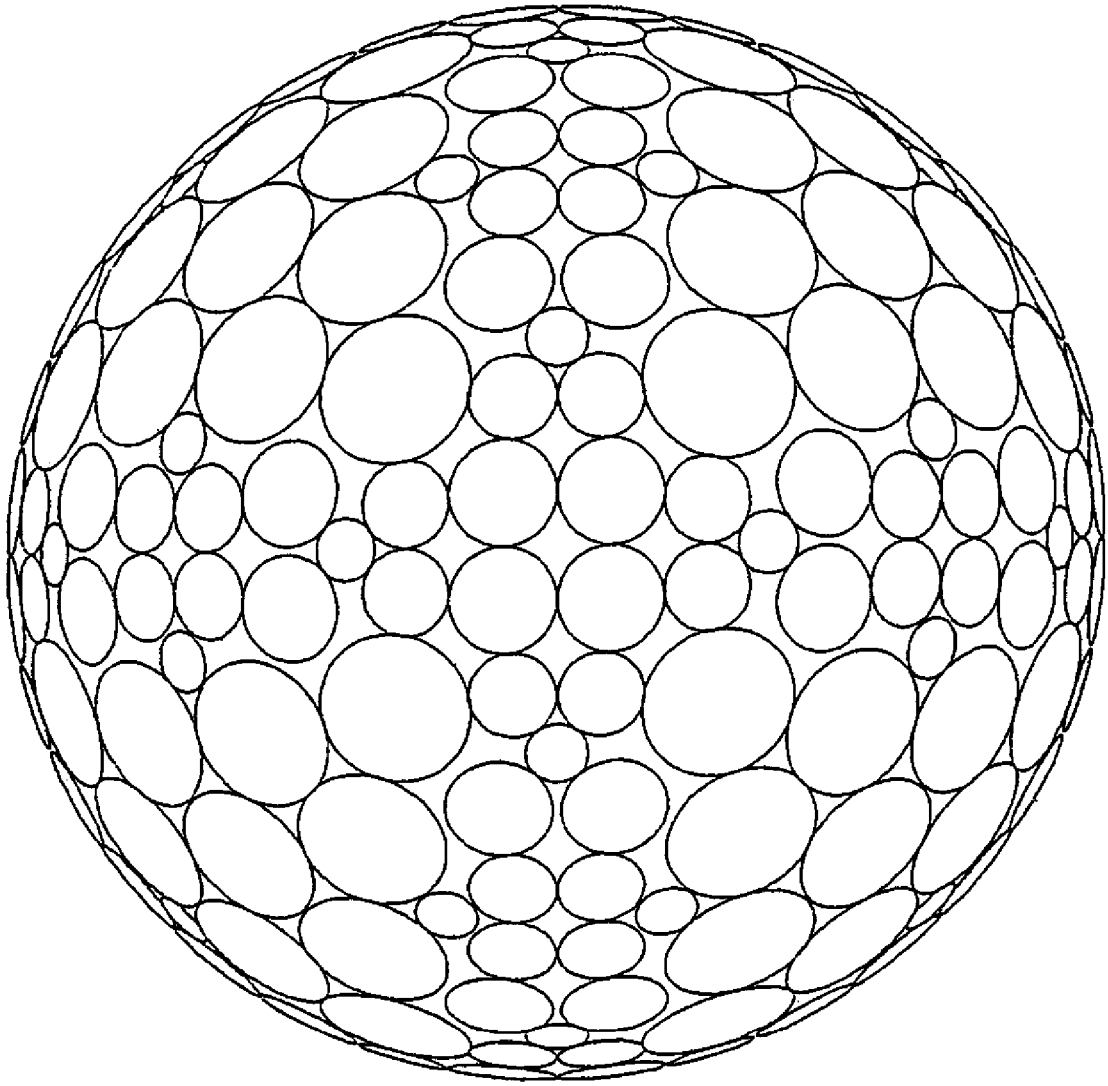
FIG. 5 is a plan view illustrating a golf ball provided with a type II dimple pattern.
Figure 6:
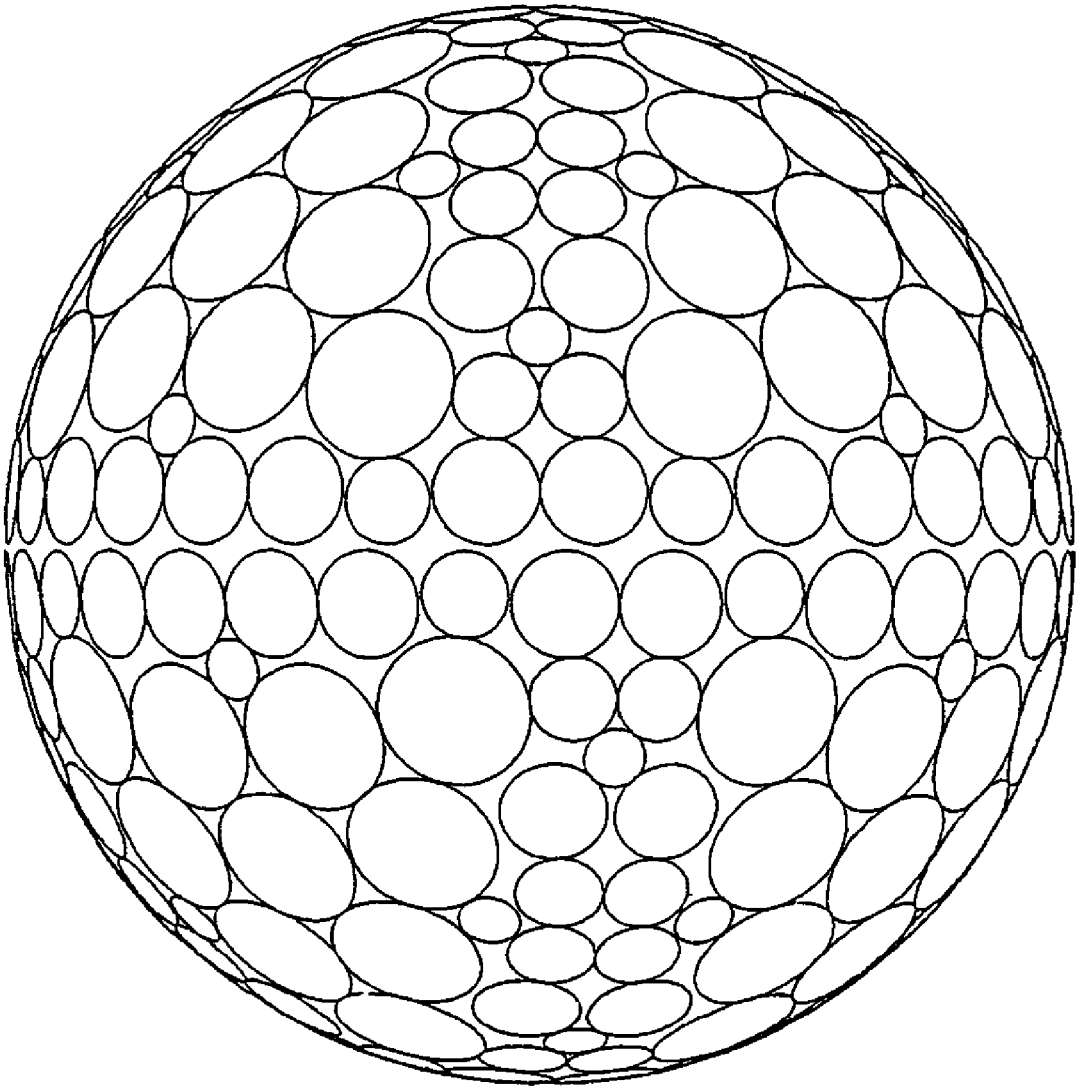
FIG. 6 is a front view illustrating the golf ball shown in FIG. 5.
Figure 7:
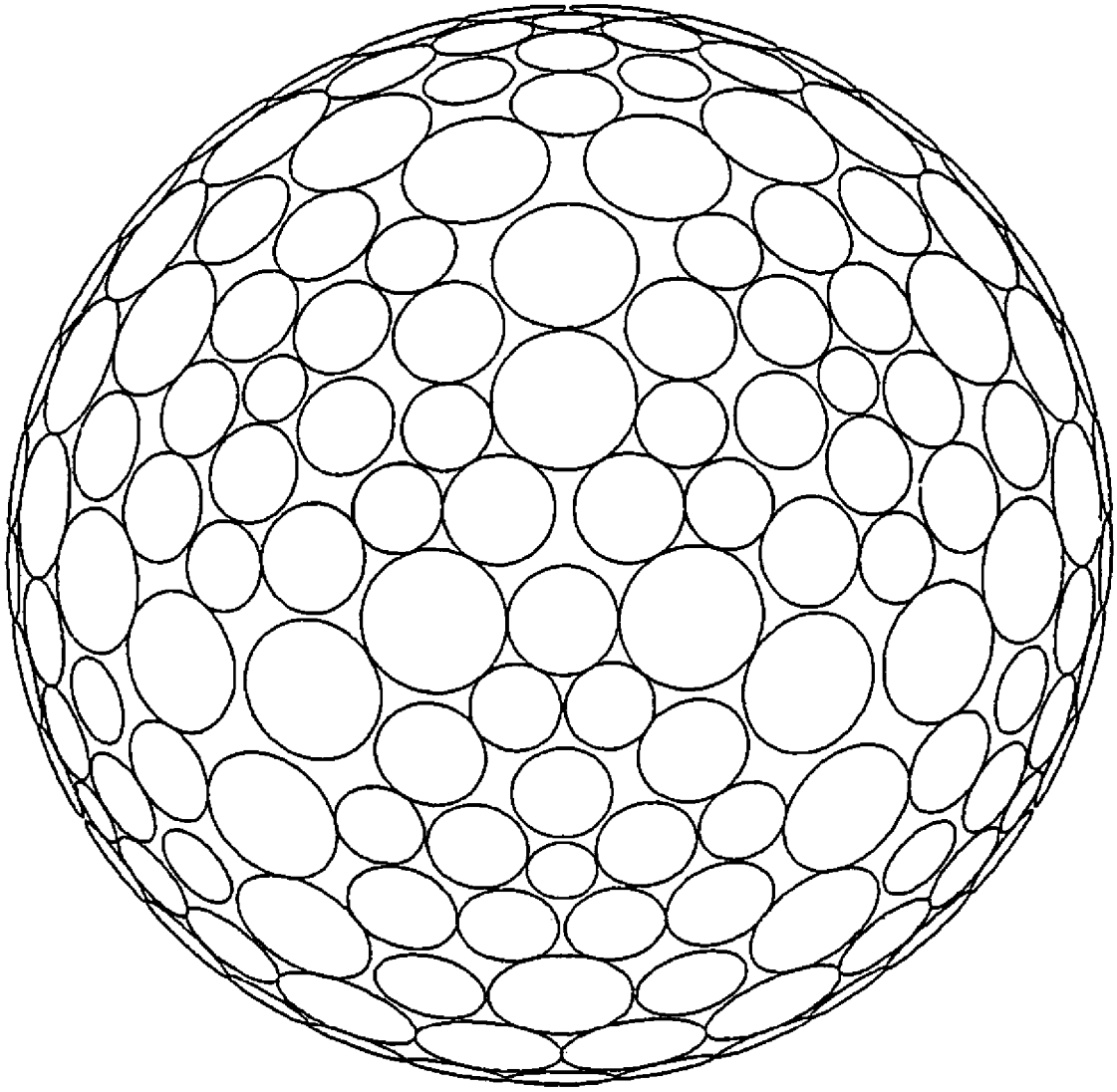
FIG. 7 is a plan view illustrating a golf ball provided with a type III dimple pattern.
Figure 8:
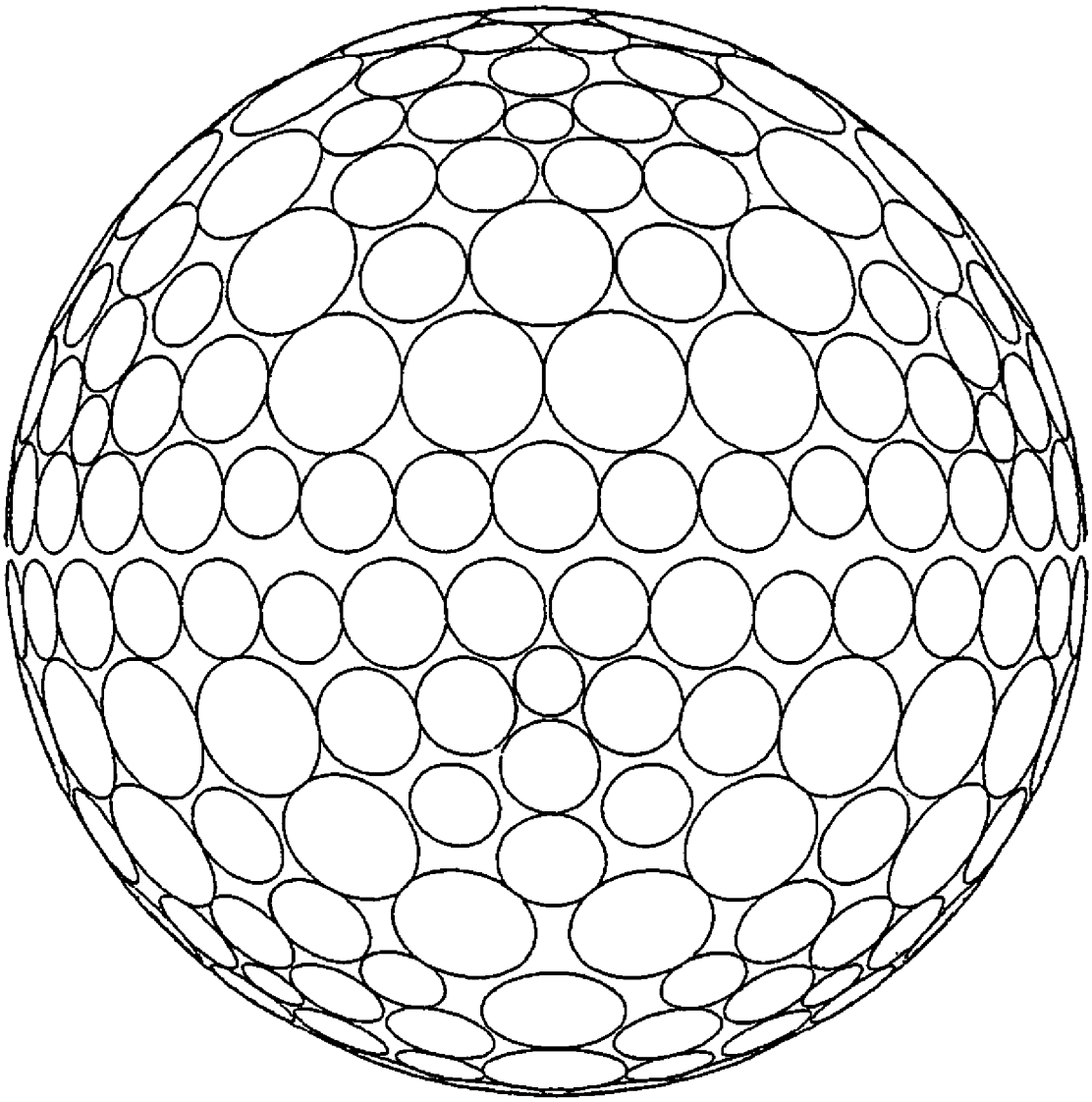
FIG. 8 is a front view illustrating the golf ball shown in FIG. 7.
Figure 9:
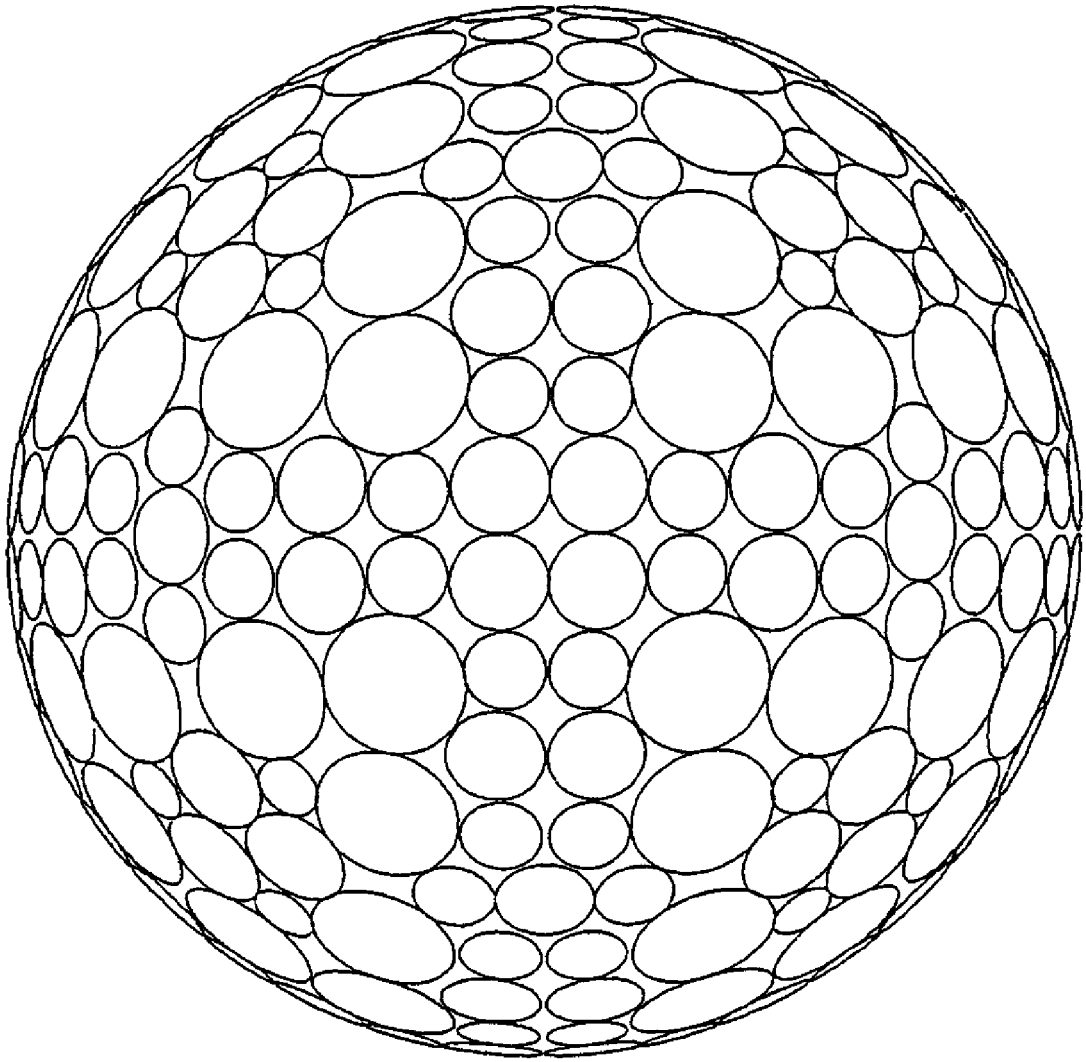
FIG. 9 is a plan view illustrating a golf ball provided with a type IV dimple pattern.
Figure 10:
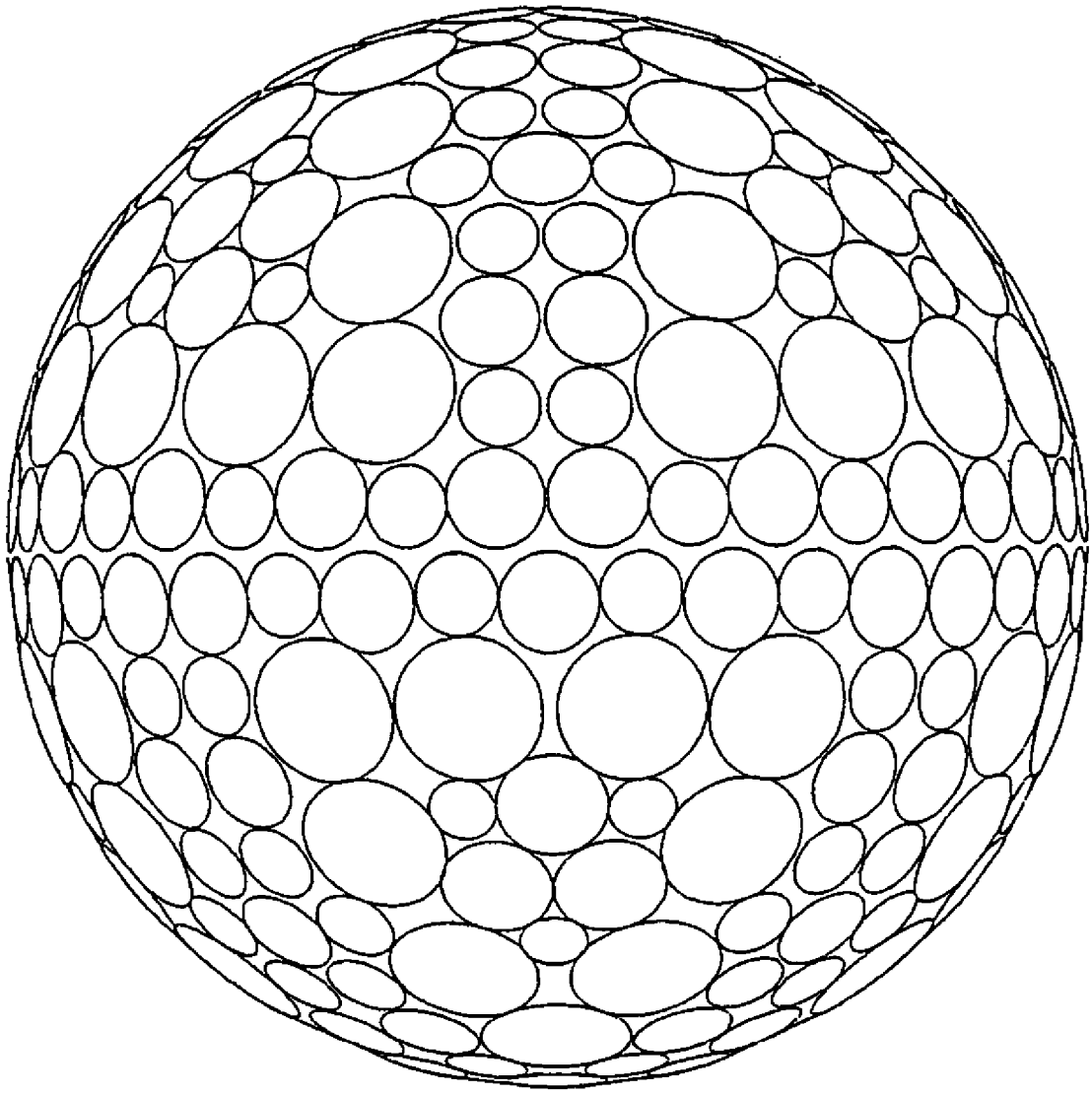
FIG. 10 is a front view illustrating the golf ball shown in FIG. 9.
Figure 11:
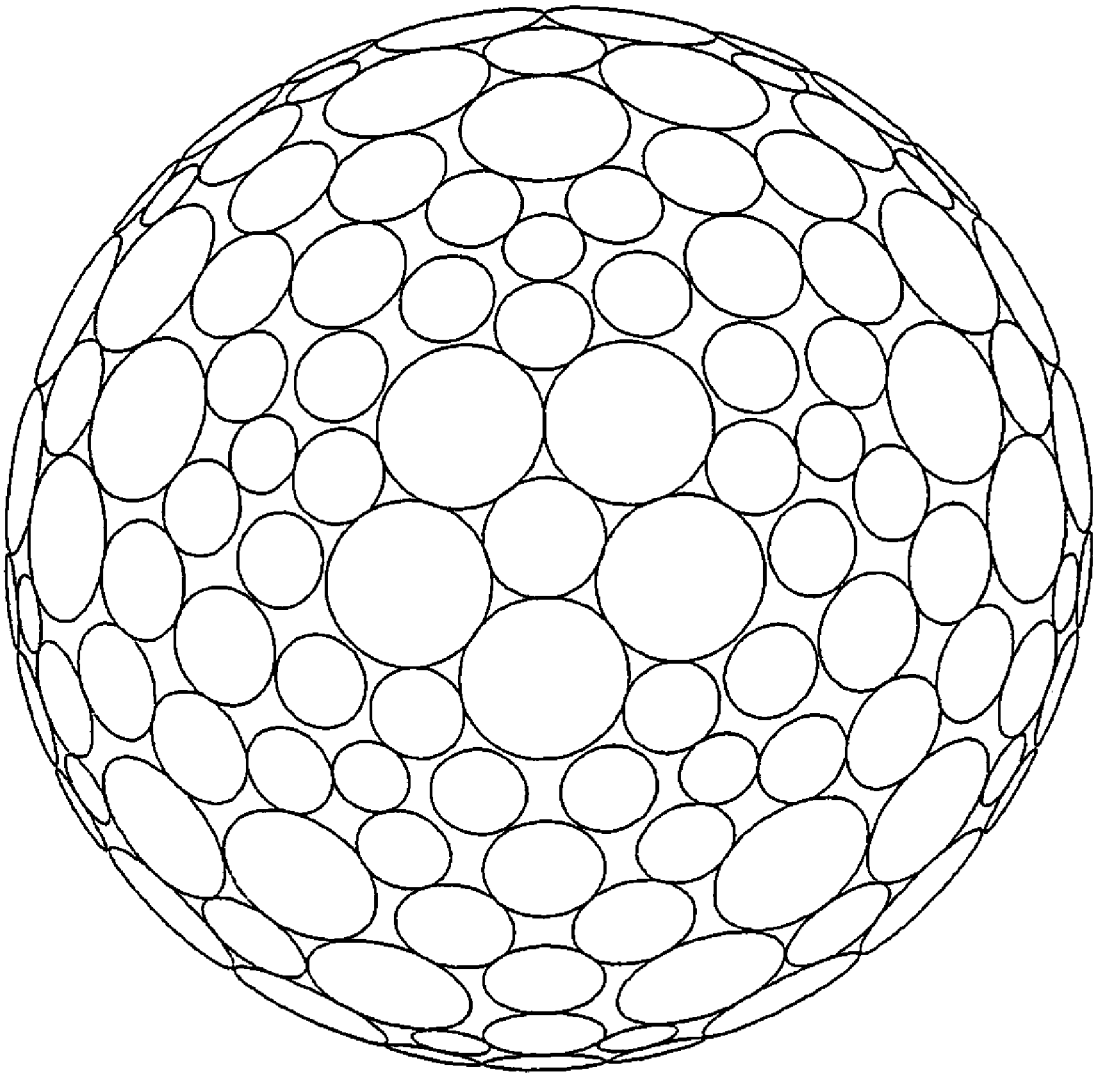
FIG. 11 is a plan view illustrating a golf ball provided with a type V dimple pattern.
Figure 12:
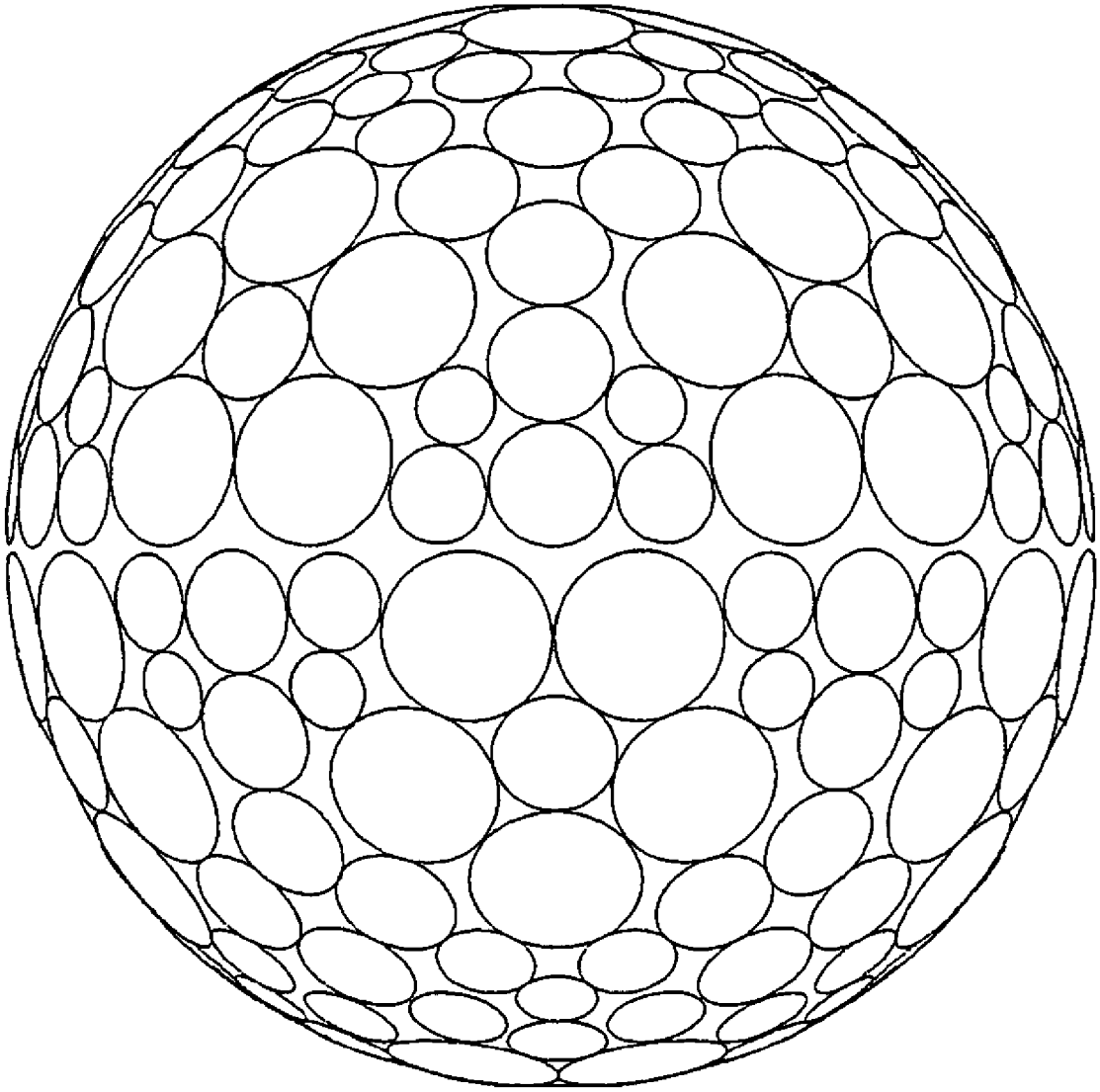
FIG. 12 is a front view illustrating the golf ball shown in FIG. 11.

| | Kind | Number-ratio (number-%) | Diameter (mm) | Depth (mm) | Volume v ($mm^3$) | Area s ($mm^2$) | Contour length x (mm) | Plan view Front view |
|---|---|---|---|---|---|---|---|---|
| Type I | A | 18–6.1 | 5.60 | 0.315 | 1.614 | 24.63 | 17.59 | FIG. 2 |
| | B | 102–34.7 | 5.10 | 0.281 | 1.307 | 20.43 | 16.02 | FIG. 3 |
| | C | 24–8.2 | 4.85 | 0.266 | 1.185 | 18.47 | 15.24 | |
| | D | 18–6.1 | 4.50 | 0.246 | 1.011 | 15.90 | 14.14 | |
| | E | 72–24.5 | 4.25 | 0.232 | 0.891 | 14.19 | 13.35 | |
| | F | 36–12.2 | 3.90 | 0.217 | 0.761 | 11.95 | 12.25 | |
| | G | 24–8.2 | 2.75 | 0.171 | 0.379 | 5.94 | 8.64 | |
| Type II | A | 80–27.8 | 6.20 | 0.360 | 2.020 | 30.19 | 19.48 | FIG. 5 |
| | B | 88–30.6 | 4.30 | 0.240 | 0.958 | 14.52 | 13.51 | FIG. 6 |
| | C | 80–27.8 | 3.50 | 0.204 | 0.634 | 9.62 | 11.00 | |
| | D | 40–13.9 | 2.50 | 0.168 | 0.324 | 4.91 | 7.85 | |
| Type III | A | 66–22.9 | 5.80 | 0.338 | 1.857 | 26.42 | 18.22 | FIG. 7 |
| | B | 78–27.1 | 4.40 | 0.249 | 1.027 | 15.21 | 13.82 | FIG. 8 |
| | C | 84–29.2 | 4.00 | 0.228 | 0.843 | 12.57 | 12.57 | |
| | D | 48–16.7 | 3.60 | 0.206 | 0.664 | 10.18 | 11.31 | |
| | E | 12–4.2 | 2.80 | 0.169 | 0.381 | 6.16 | 8.80 | |
| Type IV | A | 72–22.5 | 6.00 | 0.344 | 1.876 | 28.27 | 18.85 | FIG. 9 |
| | B | 24–7.5 | 4.50 | 0.253 | 1.064 | 15.90 | 14.14 | FIG. 10 |
| | C | 88–27.5 | 4.00 | 0.228 | 0.843 | 12.57 | 12.57 | |
| | D | 112–35.0 | 3.30 | 0.201 | 0.588 | 8.55 | 10.37 | |
| | E | 24–7.5 | 2.70 | 0.174 | 0.377 | 5.73 | 8.48 | |
| Type V | A | 60–25.9 | 6.50 | 0.388 | 2.312 | 33.18 | 20.42 | FIG. 11 |
| | B | 72–31.0 | 4.80 | 0.280 | 1.309 | 18.10 | 15.08 | FIG. 12 |
| | C | 70–30.2 | 3.90 | 0.242 | 0.916 | 11.95 | 12.25 | |
| | D | 30–12.9 | 2.80 | 0.183 | 0.424 | 6.16 | 8.80 | |

TABLE 4

Specification of Dimples

Figure 13:
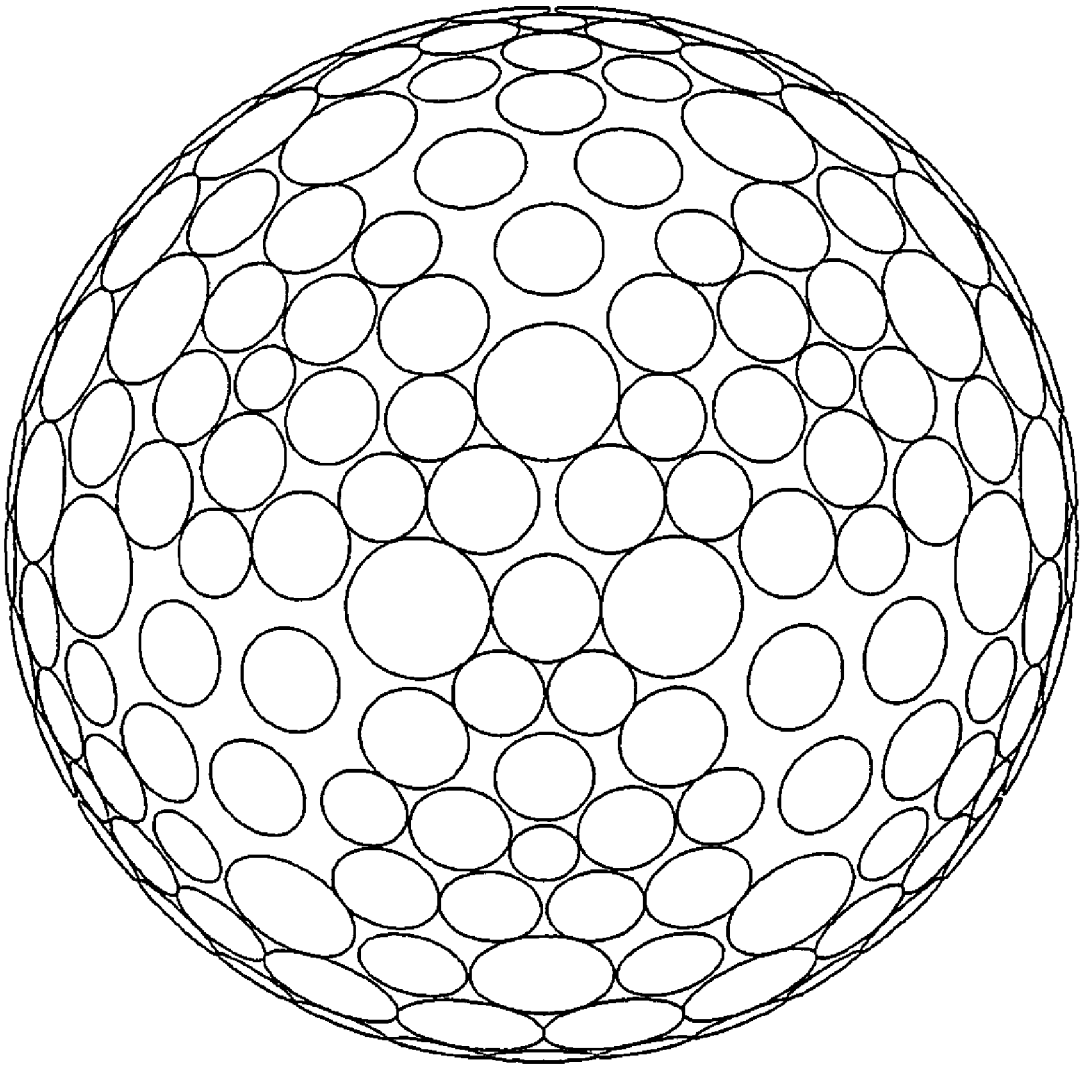
FIG. 13 is a plan view illustrating a golf ball provided with a type VI dimple pattern.
Figure 14:
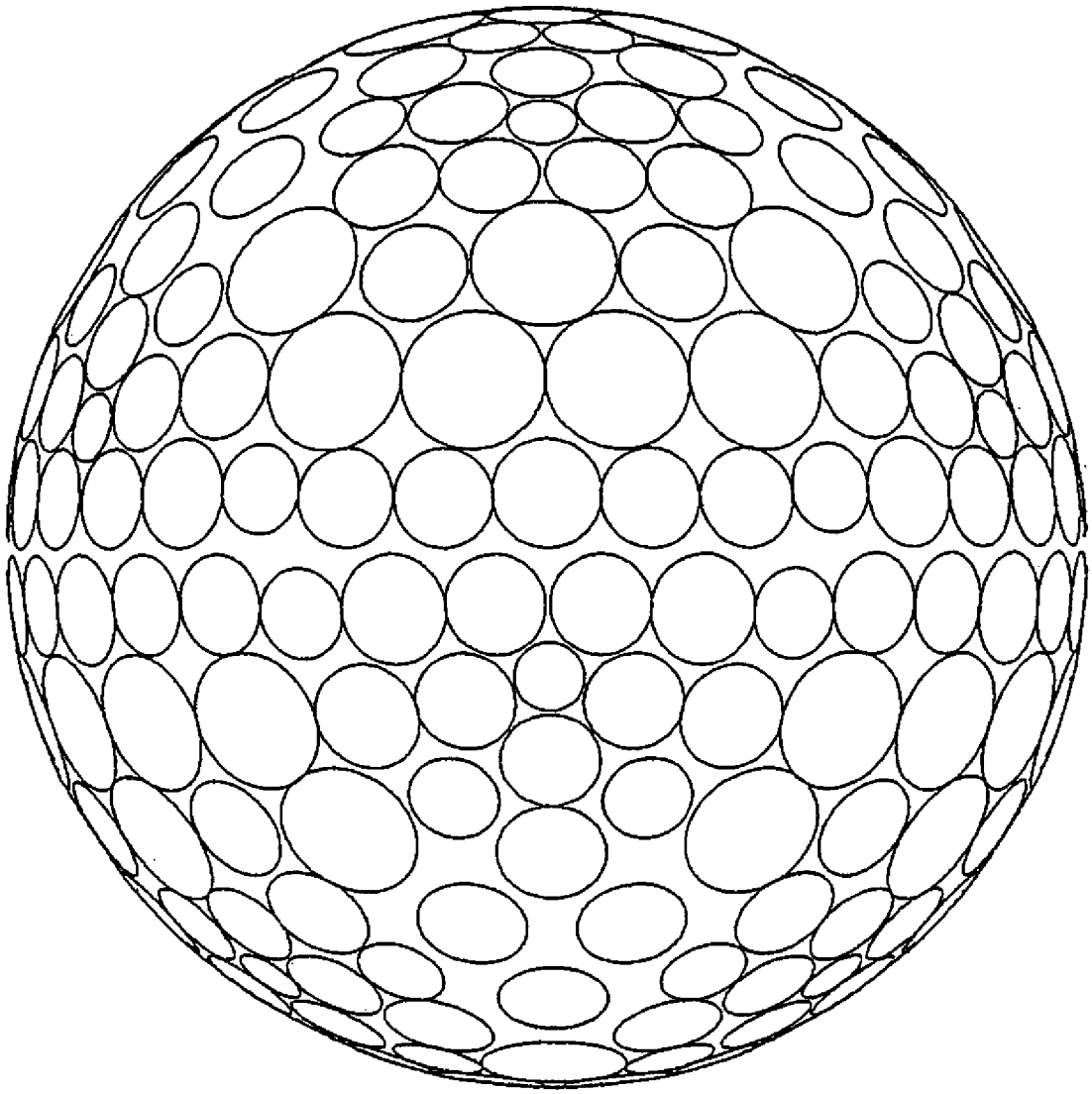
FIG. 14 is a front view illustrating the golf ball shown in FIG. 13.
Figure 15:
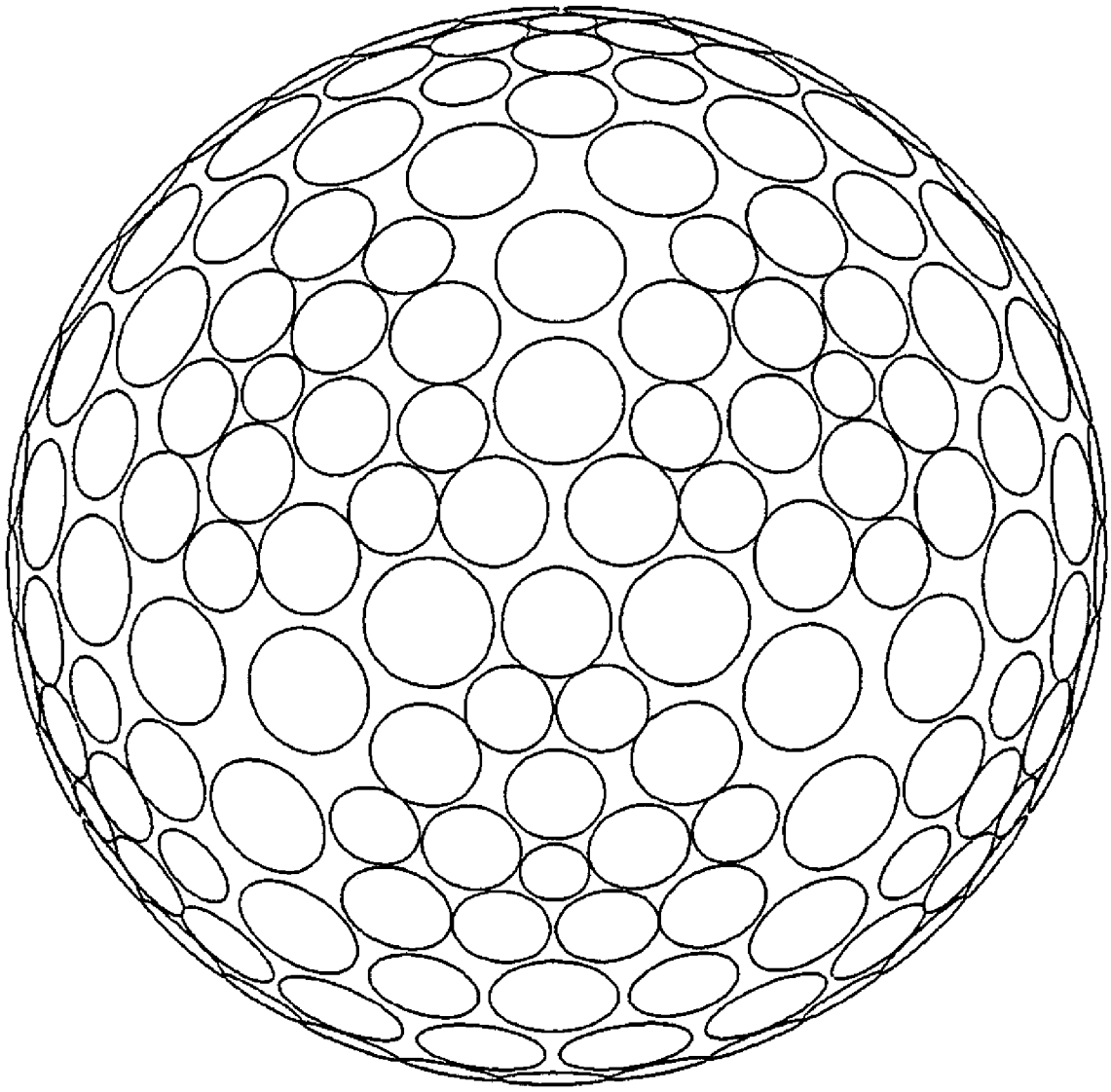
FIG. 15 is a plan view illustrating a golf ball provided with a type VII dimple pattern.
Figure 16:
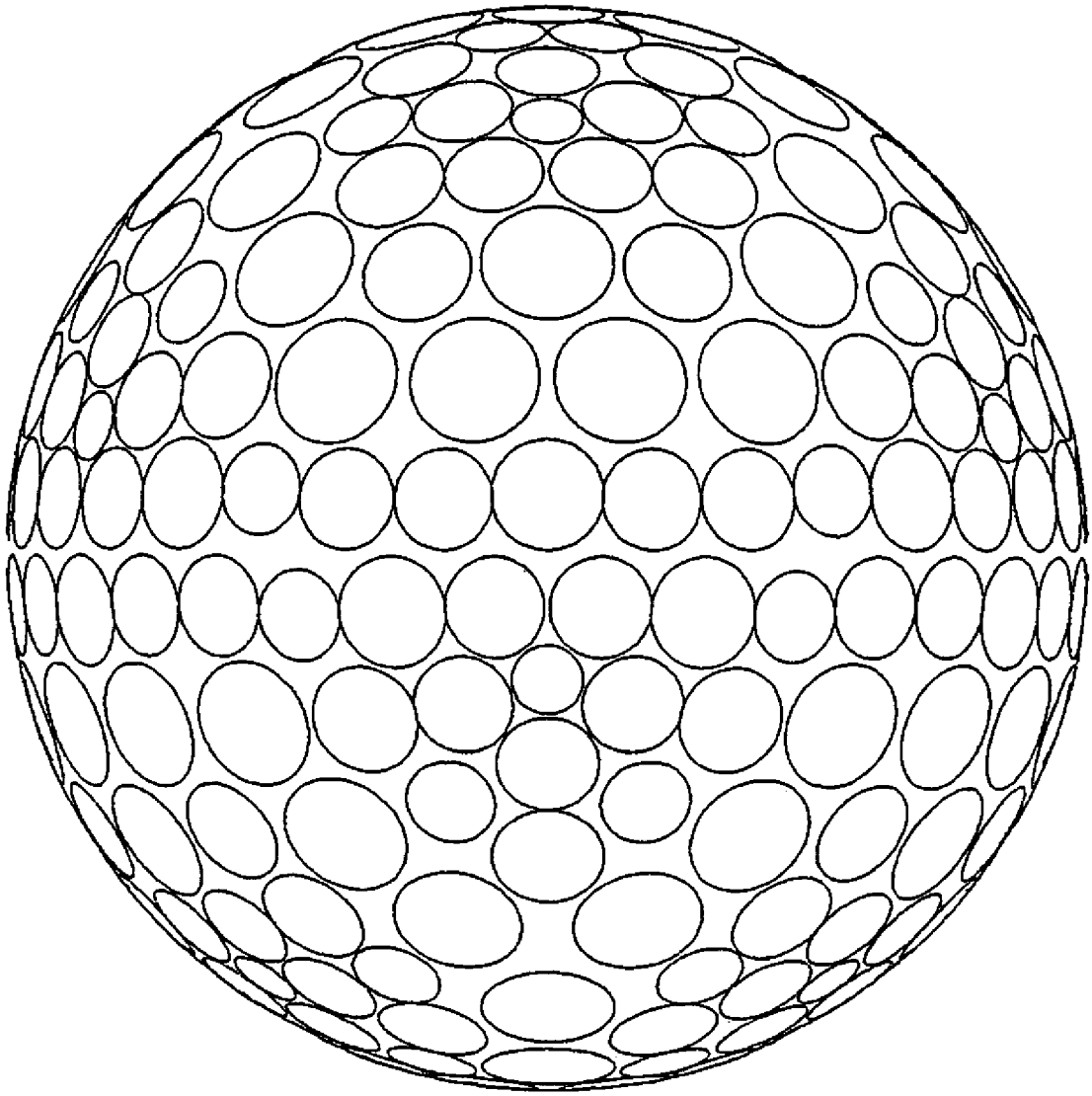
FIG. 16 is a front view illustrating the golf ball shown in FIG. 15.
Figure 17:
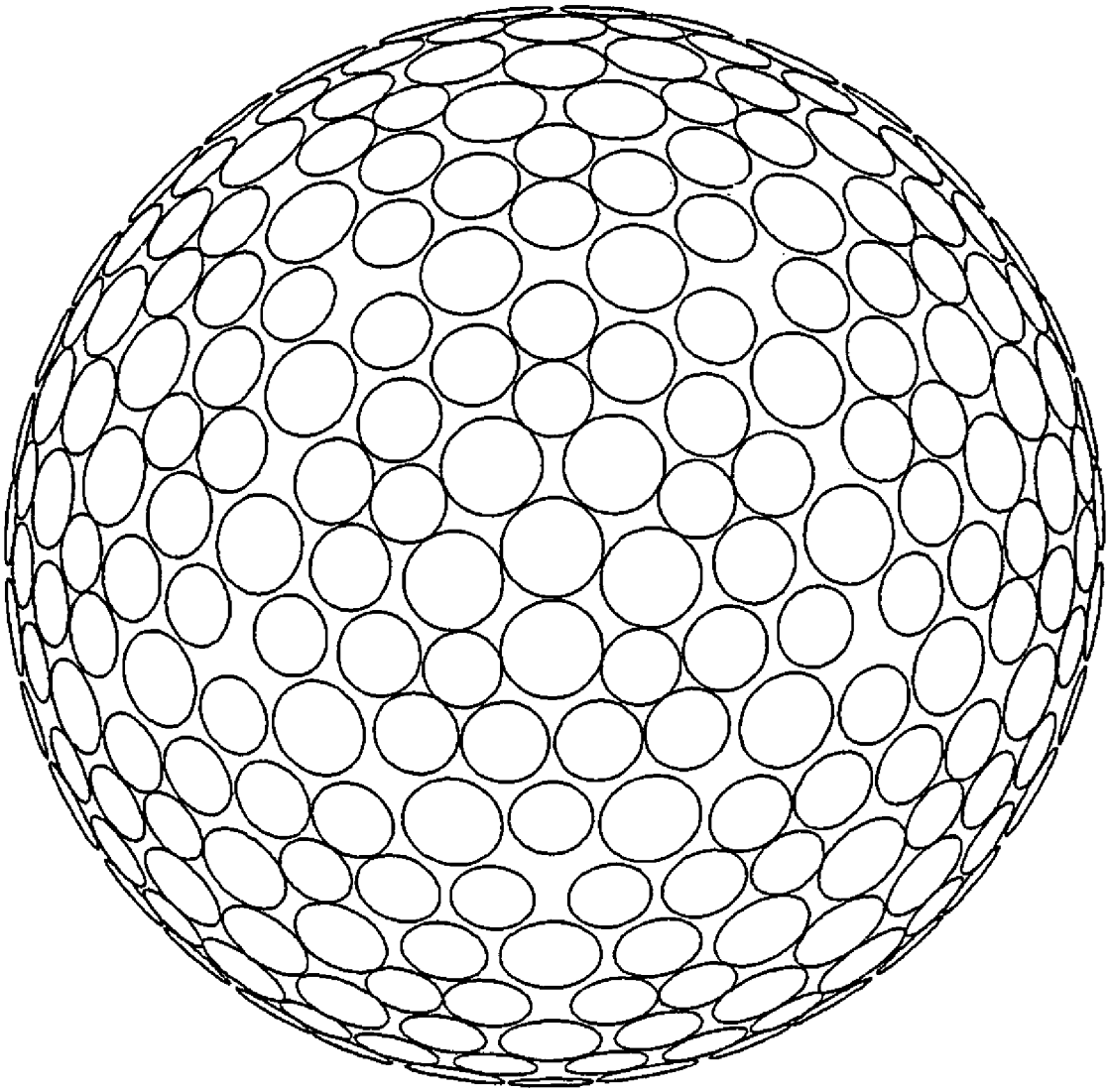
FIG. 17 is a plan view illustrating a golf ball provided with a type VIII dimple pattern.
Figure 18:
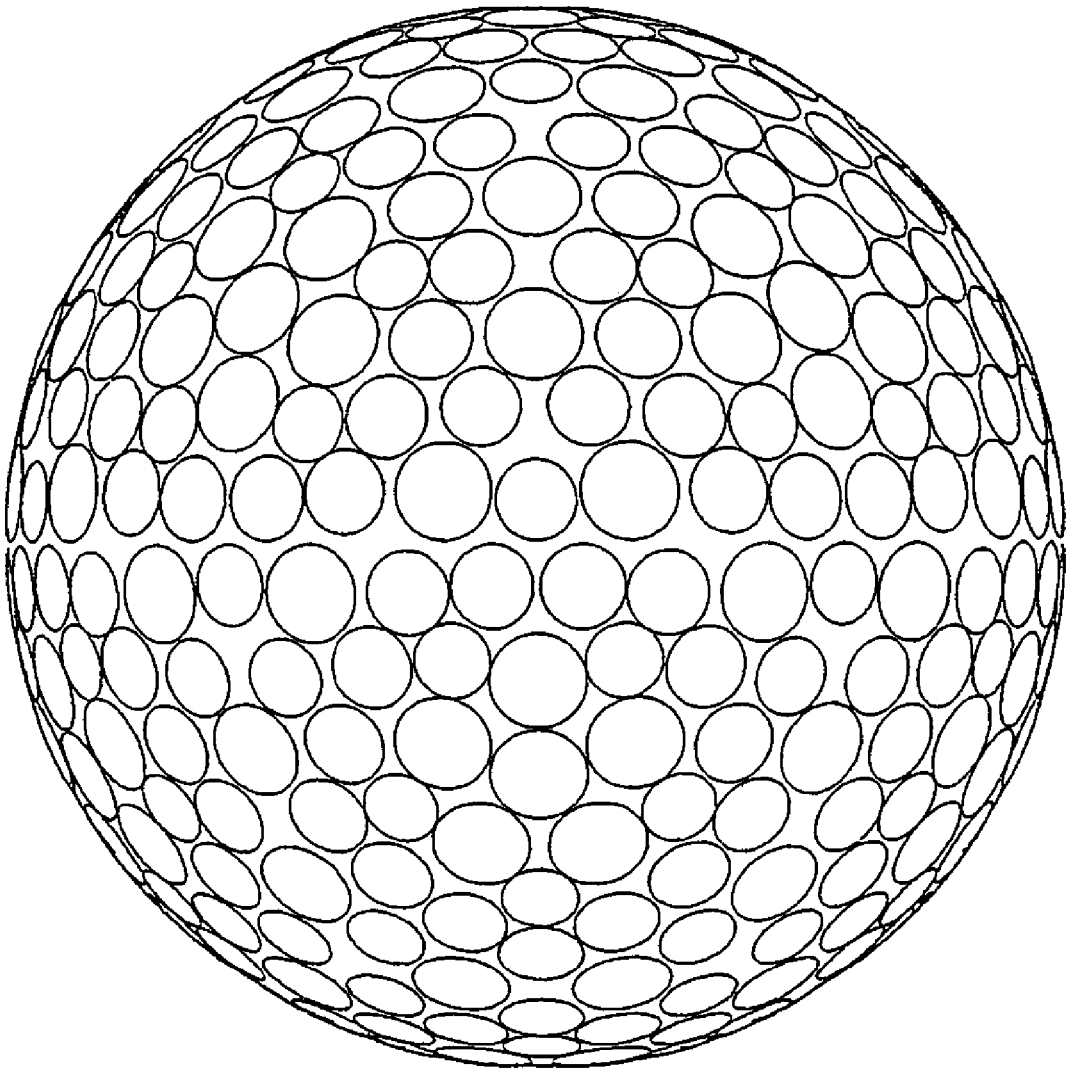
FIG. 18 is a front view illustrating the golf ball shown in FIG. 17.
Figure 19:
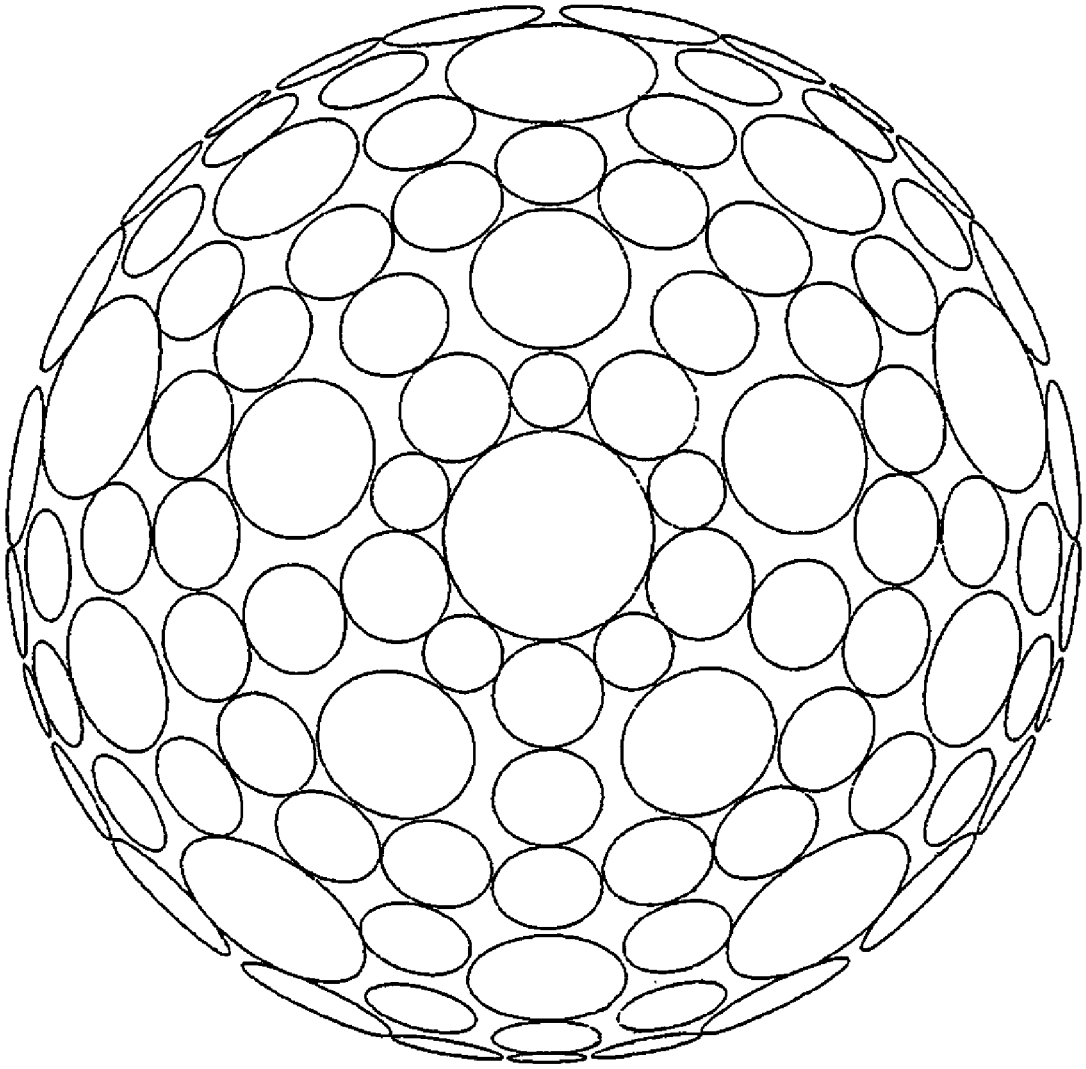
FIG. 19 is a plan view illustrating a golf ball provided with a type IX dimple pattern.
Figure 20:
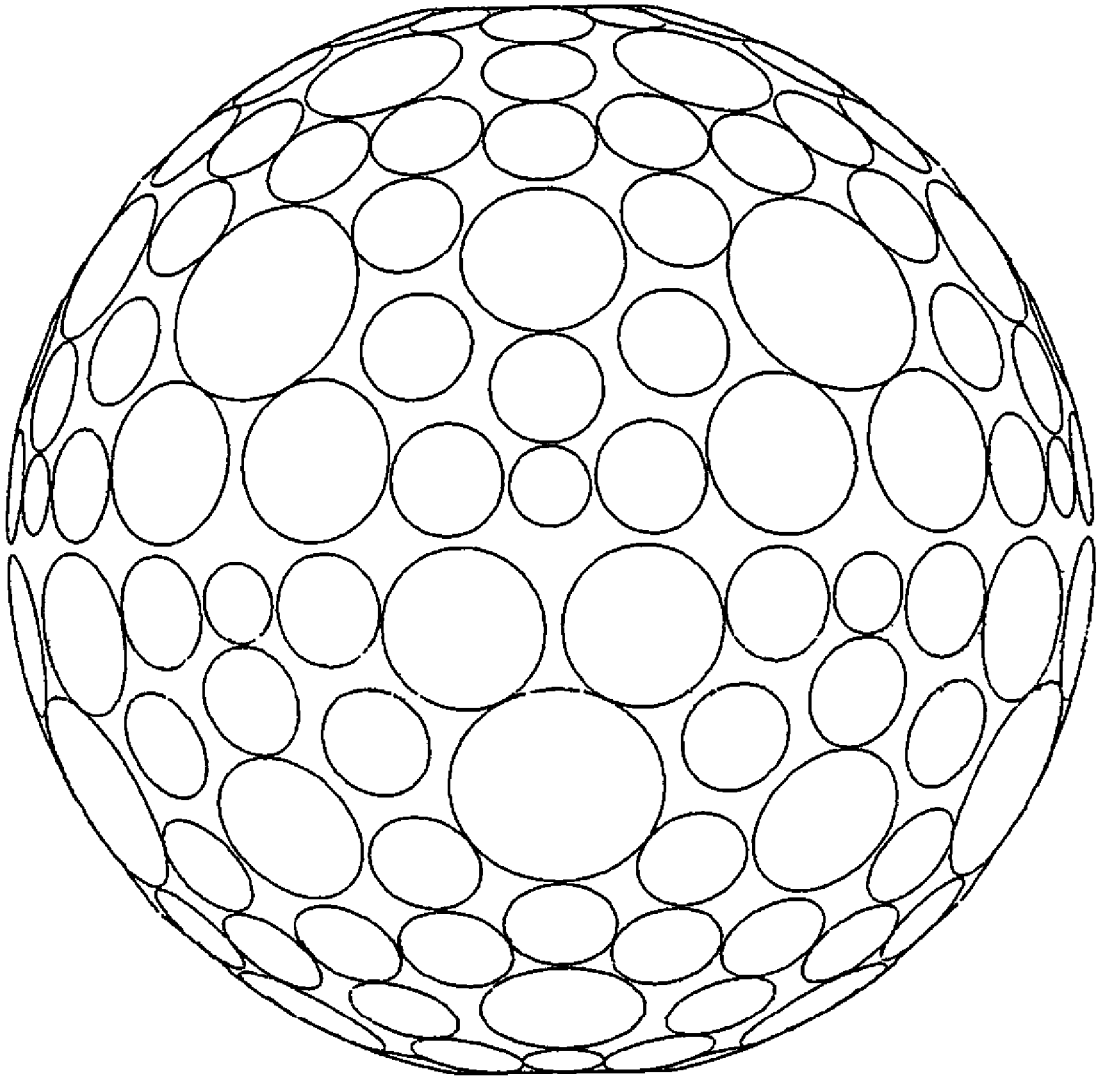
FIG. 20 is a front view illustrating the golf ball shown in FIG. 19.

| | Kind | Number-ratio (number-%) | Diameter (mm) | Depth (mm) | Volume v ($mm^3$) | Area s ($mm^2$) | Contour length x (mm) | Plan view Front view |
|---|---|---|---|---|---|---|---|---|
| Type VI | A | 48–16.7 | 5.80 | 0.338 | 1.857 | 26.42 | 18.22 | FIG. 13 |
| | B | 96–33.3 | 4.40 | 0.257 | 1.088 | 15.21 | 13.82 | FIG. 14 |
| | C | 84–29.2 | 4.00 | 0.238 | 0.904 | 12.57 | 12.57 | |
| | D | 48–16.7 | 3.60 | 0.218 | 0.723 | 10.18 | 11.31 | |
| | E | 12–4.2 | 2.80 | 0.187 | 0.437 | 6.16 | 8.80 | |
| Type VII | A | 66–22.9 | 5.20 | 0.306 | 1.567 | 21.24 | 16.34 | FIG. 15 |
| | B | 78–27.1 | 4.40 | 0.261 | 1.122 | 15.21 | 13.82 | FIG. 16 |
| | C | 84–29.2 | 4.00 | 0.241 | 0.924 | 12.57 | 12.57 | |
| | D | 48–16.7 | 3.60 | 0.224 | 0.756 | 10.18 | 11.31 | |
| | E | 12–4.2 | 2.80 | 0.187 | 0.437 | 6.16 | 8.80 | |
| Type VIII | A | 132–30.6 | 4.10 | 0.239 | 0.931 | 13.20 | 12.88 | FIG. 17 |
| | B | 180–41.7 | 3.55 | 0.206 | 0.654 | 9.90 | 11.15 | FIG. 18 |
| | C | 60–13.9 | 3.40 | 0.200 | 0.601 | 9.08 | 10.68 | |
| | D | 60–13.9 | 3.25 | 0.195 | 0.553 | 8.30 | 10.21 | |
| Type IX | A | 12–5.9 | 8.50 | 0.548 | 3.420 | 56.75 | 26.70 | FIG. 19 |
| | B | 40–19.8 | 6.50 | 0.396 | 2.441 | 33.18 | 20.42 | FIG. 20 |
| | C | 130–64.6 | 4.60 | 0.272 | 1.228 | 16.62 | 14.45 | |
| | D | 20–9.9 | 3.20 | 0.203 | 0.578 | 8.04 | 10.05 | |

[Measurement of Amount of Compressive Deformation]

The golf ball was first placed on a hard plate made of metal. Next, a cylinder made of metal was rendered to descend gradually toward the golf ball, and thus the golf ball, which was intervened between the bottom face of this cylinder and the hard plate, was deformed. Then, a migration distance of the cylinder was measured, starting from the state in which an initial load of 98 N was applied to the golf ball up to the state in which a final load of 1274 N was applied thereto. The results thus obtained are shown in Table 5 below.

[Travel Distance Test]

A driver with a metal head was equipped with a swing machine of Golf Laboratory Co. Then the machine condition was set to give the head speed of 45 m/sec, and golf balls were hit therewith. Travel distance (i.e., the distance from the launching point to the point where the ball stopped) was thus measured. Mean values of 5 times measurement are shown in Table 5 below.

[Scuff Resistance]

A pitching wedge was equipped with the swing machine described above. Then the machine condition was set to give the head speed of 36 m/sec, and golf balls were hit therewith. The surface condition of the golf ball after hitting was visually observed, and was evaluated in accordance with the following criteria.

A: with small number of scratches although not remarkable

B: with scratches and fuzz

C: with parts scraped away from the surface of the cover, and remarkable fuzz

[Evaluation of Control Performance]

Using a pitching wedge, golf balls were hit by 10 senior golf players. Thus, the control performance was evaluated. Those which were liable to be spun around and excellent in the control performance were assigned "A"; those which were difficult to be spun around and inferior in the control performance were assigned "C"; and those which were in an intermediate range between both evaluations were assigned "B". Results of evaluation which gave a maximum convergence are presented in Table 5 below.

TABLE 5

Results of evaluation

| | Example 1 | Example 2 | Example 3 | Example 4 | Example 5 | Example 6 | Example 7 |
|---|---|---|---|---|---|---|---|
| Hardness Hm of mid layer | 64 | 64 | 61 | 64 | 64 | 64 | 64 |
| Hardness Hc of cover | 42 | 47 | 47 | 42 | 42 | 42 | 42 |
| Difference of hardness (Hm-Hc) | 22 | 17 | 14 | 22 | 22 | 22 | 22 |
| Ball diameter D (mm) | 42.7 | 42.7 | 42.7 | 42.7 | 42.7 | 42.7 | 42.7 |
| Maximum dimple diameter dmax (mm) | 5.6 | 5.6 | 5.6 | 6.2 | 5.8 | 6.0 | 6.5 |
| Ratio R1 (%) | 13.1 | 13.1 | 13.1 | 14.5 | 13.6 | 14.1 | 15.2 |
| Ratio R2 (%) | 49.0 | 49.0 | 49.0 | 27.8 | 22.9 | 22.5 | 56.9 |
| Surface area occupation ratio Y (%) | 84.7 | 84.7 | 84.7 | 81.3 | 79.4 | 80.6 | 75.3 |
| Mean occupation ratio y (%) | 0.288 | 0.288 | 0.288 | 0.282 | 0.276 | 0.252 | 0.325 |

TABLE 5-continued

| Results of evaluation | | | | | | | |
|---|---|---|---|---|---|---|---|
| Total contour length X (mm) | 4180.8 | 4180.8 | 4180.8 | 3940.8 | 3984.8 | 3130.7 | 3432.5 |
| Total dimple number N | 294 | 294 | 294 | 288 | 288 | 320 | 232 |
| Total volume ($mm^3$) | 634 | 634 | 634 | 684 | 620 | 634 | 688 |
| Amount of compressive deformation (mm) | 2.7 | 2.6 | 2.7 | 2.7 | 2.7 | 2.7 | 2.7 |
| Travel distance (m) | 217.5 | 218.7 | 217.2 | 216.5 | 216.9 | 216.0 | 215.2 |
| Scuff resistance | A | A | A | A | A | A | A |
| Control property | A | A | A | A | A | A | A |

| | Example 8 | Com. Example 1 | Com. Example 2 | Com. Example 3 | Com. Example 4 | Com. Example 5 |
|---|---|---|---|---|---|---|
| Hardness Hm of mid layer | 64 | 64 | 64 | 64 | 64 | 64 |
| Hardness Hc of cover | 42 | 60 | 48 | 42 | 42 | 42 |
| Difference of hardness (Hm-Hc) | 22 | 4 | 16 | 22 | 22 | 22 |
| Ball diameter D (mm) | 42.7 | 42.7 | 42.7 | 42.7 | 42.7 | 42.7 |
| Maximum dimple diameter dmax (mm) | 5.8 | 5.6 | 5.6 | 5.2 | 4.1 | 8.5 |
| Ratio R1 (%) | 13.6 | 13.1 | 13.1 | 12.2 | 9.6 | 19.9 |
| Ratio R2 (%) | 16.7 | 49.0 | 49.0 | 22.9 | 0.0 | 19.8 |
| Surface area occupation ratio Y (%) | 75.9 | 84.7 | 84.7 | 73.4 | 79.7 | 75.6 |
| Mean occupation ratio y (%) | 0.263 | 0.288 | 0.288 | 0.255 | 0.185 | 0.374 |
| Total contour length X (mm) | 3905.6 | 4180.8 | 4180.8 | 3860.4 | 4961.2 | 3217.0 |
| Total dimple number N | 288 | 294 | 294 | 288 | 432 | 202 |
| Total volume ($mm^3$) | 588 | 634 | 634 | 559 | 496 | 760 |
| Amount of compressive deformation (mm) | 2.7 | 2.6 | 26 | 2.7 | 2.7 | 27 |
| Travel distance (m) | 215.1 | 219.1 | 216.6 | 212.8 | 212.0 | 211.7 |
| Scuff resistance | A | B | C | A | A | A |
| Control property | A | C | B | A | A | A |

As is clear from Table 5, the golf ball of each of Examples is excellent in all terms of the flight performance, the scuff resistance and the control performance. Accordingly, advantages of the present invention are clearly indicated by these results of evaluation.

The description herein above is merely for illustrative examples, therefore, various modifications can be made without departing from the principles of the present invention.

The invention claimed is:

1. A golf ball which comprises a core, a cover and numerous dimples formed on the surface of said cover, wherein a base polymer of said cover includes a thermoplastic polyurethane elastomer as a principal component, Shore D hardness of said cover is 30 or greater and 55 or less, a surface area occupation ratio Y of these dimples is equal to or greater than 75%, a ratio R1 of the diameter $d_{max}$ of the maximum dimple to the diameter D of said golf ball is 13.0% or greater and 18.0% or less, and a ratio R2 of the number of dimples having the diameter d accounting for 13.0% or greater and 18.0% or less of said diameter D of the golf ball, to the total number N of the dimples is equal to or greater than 20%.

2. The golf ball according to claim 1 wherein a mean occupation ratio y which is a value calculated by dividing said surface area occupation ratio Y by total number N of the dimples is equal to or greater than 0.22%.

3. The golf ball according to claim 1 wherein a summation X of the contour length x of the dimples (total contour length) and the surface area occupation ratio Y satisfy the relationship represented by the following formula (1).

$$X \leqq 38.82 \times Y + 1495 \quad (1).$$

4. The golf ball according to claim 1 wherein the core has a center and a mid layer, and difference (Hm−Hc) between Shore D hardness Hm of the mid layer and Shore D hardness Hc of the cover is equal to or greater than 5.

* * * * *